US010689925B2

(12) United States Patent
Angelle et al.

(10) Patent No.: US 10,689,925 B2
(45) Date of Patent: Jun. 23, 2020

(54) PIPE WRENCH

(71) Applicant: Frank's International, LLC, Houston, TX (US)

(72) Inventors: Jeremy R. Angelle, Youngsville, LA (US); Robert L. Thibodeaux, Lafayette, LA (US); Joshua J. Hebert, Breaux Bridge, LA (US); John E. Stelly, Breaux Bridge, LA (US); Logan E. Smith, Youngsville, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 442 days.

(21) Appl. No.: 15/481,334

(22) Filed: Apr. 6, 2017

(65) Prior Publication Data

US 2017/0370166 A1 Dec. 28, 2017

Related U.S. Application Data

(60) Provisional application No. 62/355,803, filed on Jun. 28, 2016.

(51) Int. Cl.
*E21B 19/16* (2006.01)
*E21B 17/042* (2006.01)

(52) U.S. Cl.
CPC ..... *E21B 19/161* (2013.01); *E21B 17/042* (2013.01); *E21B 19/164* (2013.01)

(58) Field of Classification Search
CPC ..... E21B 19/16; E21B 19/18; E21B 19/161; E21B 19/164; E21B 19/165; E21B 19/167; E21B 31/12
See application file for complete search history.

(56) References Cited

U.S. PATENT DOCUMENTS 3,180,186 A * 4/1965 Catland ..... B23B 31/1269 81/57.18
4,827,808 A * 5/1989 Haynes ..... E21B 19/164 81/57.18
6,776,070 B1 8/2004 Mason et al.
7,191,686 B1 3/2007 Angelle et al.
(Continued)

OTHER PUBLICATIONS

International Search Report and Written Opinion of PCT Application No. PCT/US2017/026454 dated Jul. 13, 2017: pp. 1-17.

*Primary Examiner* — Cathleen R Hutchins
*Assistant Examiner* — Dany E Akakpo
(74) *Attorney, Agent, or Firm* — MH2 Technology Law Group LLP

(57) ABSTRACT

A pipe wrench for making-up or breaking-out a threaded connection between a first tubular member and a second tubular member includes an upper wrench assembly with a pair of upper jaw assemblies configured to grip the first tubular member and a lower wrench assembly with a pair of lower jaw assemblies configured to grip the second tubular member. The upper and lower wrench assemblies are concentrically constrained, axially overlap, and radially engage with one another. Each of the upper and lower wrench assemblies independently includes a frame with a curved segment containing an arc at an angle of about 160° to about 200°. The upper and lower wrench assemblies are configured to rotate the first tubular member relative to the second tubular member and can have an angle of rotation in a range from about 75° to about 180°.

19 Claims, 23 Drawing Sheets

(56) References Cited

U.S. PATENT DOCUMENTS

| | | | | |
|---|---|---|---|---|
| 7,861,618 | B2 | 1/2011 | Pietras et al. | |
| 8,240,391 | B2 | 8/2012 | Bouligny, Jr. et al. | |
| 8,601,910 | B2 | 12/2013 | Begnaud | |
| 2002/0189804 | A1* | 12/2002 | Liess | E21B 19/164 166/77.51 |
| 2005/0056122 | A1* | 3/2005 | Belik | E21B 19/161 81/57.16 |
| 2009/0211405 | A1* | 8/2009 | Hunter | E21B 19/163 81/57.16 |
| 2009/0272235 | A1 | 11/2009 | Berry | |
| 2010/0187740 | A1 | 7/2010 | Orgeron | |
| 2013/0255965 | A1 | 10/2013 | Dobush | |
| 2015/0159445 | A1 | 6/2015 | Smith et al. | |
| 2015/0165672 | A1 | 6/2015 | Montgomery | |
| 2015/0275597 | A1 | 10/2015 | Thibodeaux et al. | |
| 2015/0275598 | A1 | 10/2015 | Webre et al. | |

* cited by examiner

PIPE WRENCH

BACKGROUND

This section is intended to provide relevant background information to facilitate a better understanding of the various aspects of the described embodiments. Accordingly, it should be understood that these statements are to be read in this light and not as admissions of prior art.

In oilfield exploration and production operations, oil and gas wells are drilled in sections. The initial section of the well starts at the ground level, or in the case of offshore wells, at the seabed, and is drilled a relatively short distance due to the unconsolidated nature of soil/formation at the surface. The first well section is drilled and isolated by lowering and, in some cases, cementing in place an initial string of conductor pipe in the drilled hole. Once the initial string is drilled and isolated, the next section of the well is drilled out below the initial string and likewise isolated with surface casing that is cemented in place. As each successive section of the well is drilled, the diameter of the wellbore is reduced from the previous section of the well causing a typical well structure to resemble a multistage telescope. In order to reach the subterranean reservoir with an adequate hole diameter to facilitate the tools required to drill through hard formations found at these great depths, the diameter of the initial hole sections and casing strings used to isolate the typical initial hole sections can be within a range from about 30 inches to about 48 inches in diameter.

The tubular members used to isolate these large diameter hole sections typically contain plain end line pipes that have had a male threaded connection welded on one end of the tubular section and a female threaded connection welded on the other end. To form a continuous tubular string, these ends can be connected together, such as end-to-end by these threaded connections, with a male "pin" member of a first tubular member configured to engage the threads of a corresponding female "box" member of a second tubular member. Alternatively, a casing string can be made-up of a series of male-male ended casing joints coupled together by female-female couplers. The process by which the threaded connections are assembled is referred as "making-up" a threaded connection, and the process by which the connections are disassembled is referred as "breaking-out" the threaded connection. Individual pieces (or "joints") of oilfield tubular members may come in a variety of weights, diameters, configurations, materials, and lengths.

Generally speaking, small diameter casings have the threaded connections machined directly onto the pipe body and large diameter casings usually have threaded connections that are welded on. The welded connections that can be welded on to large diameter casings are commercially available in many different types of connectors including several types that incorporate multi-start threads. The use of a multi-start thread results in a connector design that requires only a portion of a full rotation of the pin into the box from stab in to full make-up of the threaded connection as opposed to a single start threaded connection that requires several rotations to make up the pin connection fully into the box connection. Most of the multi-start connection types require a range from 90 degrees of rotation up to 180 degrees of rotation in order to make-up a threaded joint between the two pipes.

The typical tools used to make-up threaded joints into contiguous strings are the power tongs and manual tongs. Power tongs are mechanized pipe wrenches that incorporate gear drive systems capable of rotating on a continuous basis by a central rotary gear which houses the pipe gripping elements. Regardless of whether a connection requires 3, 6, 10, or more full rotations of one joint relative to the other joint, the power tong is capable of providing continuous rotation. The power tong is capable of delivering very high torque required to generate a seal tight connection between the male threaded connection and the female threaded connection. Power tongs are available in various makes and models and can accommodate gripping tubular members ranging in outer diameter from as small as about 2⅞ inches to 20 inches. In order to accommodate gripping tubular members having outer diameters of greater than 20 inches, a power tong would have to be a very large piece of machinery that is quite heavy to manipulate on the rig floor and expensive to manufacture.

An alternative to a power tong that is in wide spread use for making-up tubular strings with large diameter casings is the use of two manual tongs. One manual tong can be secured to the lower joint that is suspended in the wellbore and snubbed off via a cable to a structure on the rig floor to prevent rotation of the string. The second manual tong can be secured to the upper "add-on" joint and attached to a winch line. The line can be used to pull the handle of the manual tong causing the add-on joint, gripped by the second manual tong, to rotate relative to the string, thereby making-up the threaded connection between the add-on joint and the string. Each pull of the handle of a manual tong can result in about 30 degrees to about 45 degrees of rotation of the upper joint into the string. In order to fully make-up a connection that requires 90 degrees rotation from stab in to full make-up with this alternative two to three pulls of the manual tong are required. There may be safety issues with the use of manual tongs, and in addition, such use of manual tongs is a time-consuming process.

BRIEF DESCRIPTION OF THE DRAWINGS

For a detailed description of the embodiments of the invention, reference will now be made to the accompanying drawings in which.

DETAILED DESCRIPTION

An automated pipe wrench and a method for making-up or breaking-out threaded connections between large outer diameter (OD) tubular members are provided herein. The pipe wrench can include an upper wrench assembly configured to grip the first tubular member and a lower wrench assembly configured to grip the second tubular member. The upper and lower wrench assemblies can be concentrically constrained, axially overlap, and radially engage with one another. Each of the upper and lower wrench assemblies can independently include a frame with a curved segment containing an arc at an angle of about 160° to about 200°. The upper and lower wrench assemblies can be configured to rotate the first tubular member relative to the second tubular member and can have an angle of rotation in a range from about 75° to about 180°.

The pipe wrench can be a hybrid device that incorporates some of the features of a power tong into a purpose built machine that is capable of making-up large tubular members having an outer diameter of about 20 inches or greater, such as, for example, about 30 inches to about 38 inches, which uses only a portion of a rotation for full make-up. In order to make these large OD threaded connections, only a portion of a rotation to be connected (make-up) or disconnected (break-out) by the pipe wrench is needed. The curved segments of the upper and lower wrench assemblies and the specified angle of rotation of the pipe wrench provide for making-up or breaking-out these large OD threaded connections. The pipe wrench can eliminate many of the hazards of making-up large diameter threaded connections that otherwise can be made by using two manual tongs connected to snub lines and winch lines traversing the rig floor. The pipe wrench can make-up large OD threaded connections while being smaller in size, lighter in weight, and more economical than a fully capable power tong of similar output torque capacity and pipe size.

Figure 1:
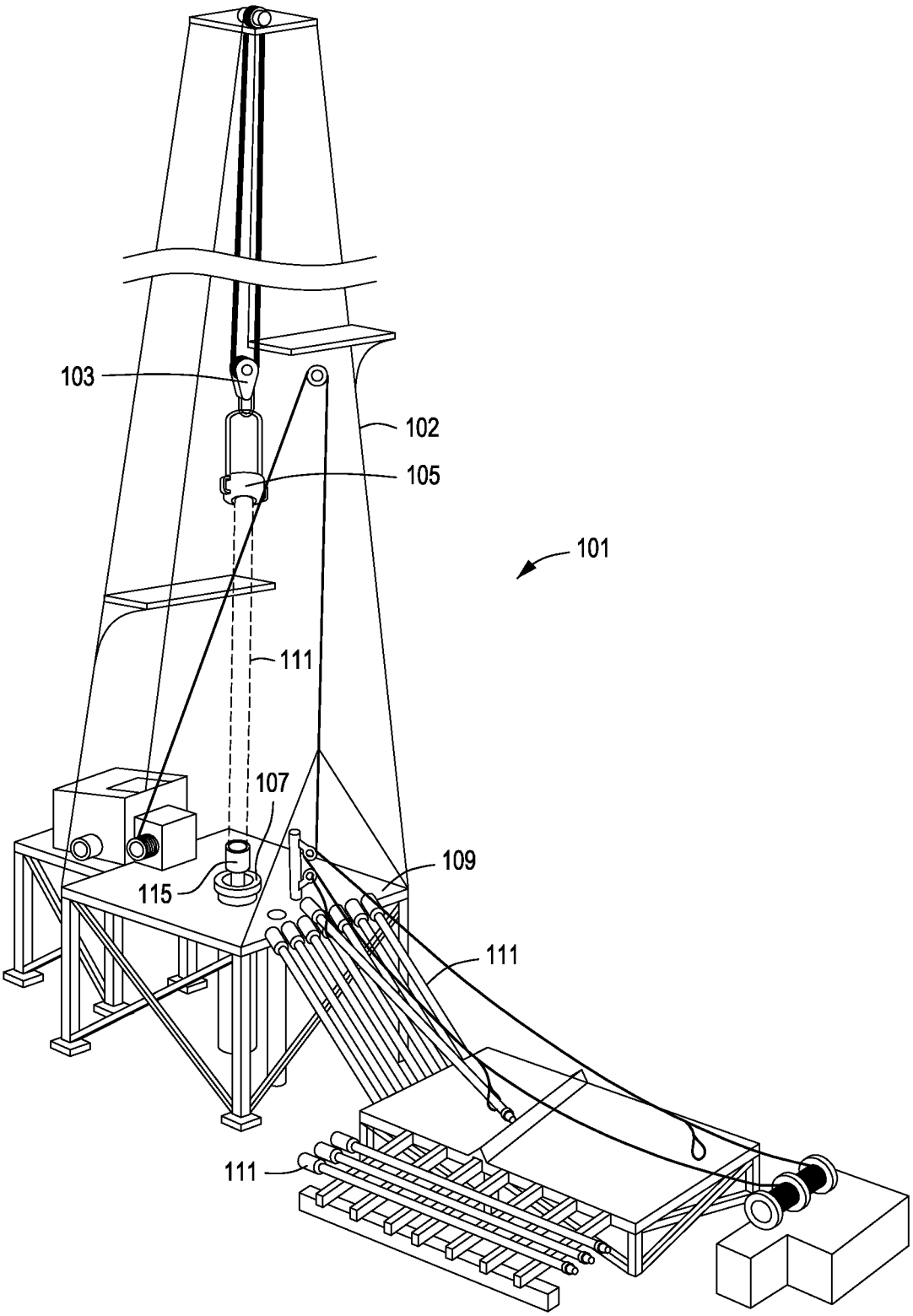
FIG. 1 is a perspective view of a drilling rig used to run one or more tubular members.

Referring to FIG. 1, a perspective view is shown of one embodiment of a drilling rig 101 used to run one or more tubular members 111, such as when running casing and/or drill pipe downhole into a wellbore. As shown, the drilling rig 101 includes a frame structure known as a "derrick" 102 from which a traveling block 103 (which may include a top drive) suspends a lifting apparatus 105. The lifting apparatus 105 may include an elevator and/or a tubular (e.g., casing) running tool connected to the quill of a top drive. Further, a gripping apparatus 107, such as a "spider" or other slip assembly, can be included at the rig floor of the drilling rig 101 and can be used to manipulate (e.g., raise, lower, rotate, and/or hold) the tubular member 111. The traveling block 103 is a device that is suspended from, at, or near the top of the derrick 102, and in this position the traveling block 103 may move up-and-down (i.e., vertically as depicted) to raise and/or lower the tubular member 111. The traveling block 103 can be a simple "pulley-style" block and may have a hook from which objects below (e.g., lifting apparatus 105 and/or top drive) can be suspended. The drilling rig 101 can be a land or offshore rig (e.g., drill ship) without departing from the spirit of the invention.

Additionally, the lifting apparatus 105 can be coupled below the traveling block 103 (and/or a top drive if present) to selectively grab or release a tubular member 111 as the tubular member 111 is to be raised and/or lowered within and from the derrick 102. Typically, a lifting apparatus 105 includes movable gripping members (e.g., slip assemblies) attached thereto and movable between a retracted (e.g., disengaged) position and an engaged position to selectively engage and grip the tubular members 111.

When making-up or breaking-out connections with the tubular members 111, a pipe wrench, a power tong, or a similar device may be included within the drilling rig 101, such as positioned on the rig floor 109 or suspended within the derrick 102. The pipe wrench may include one or more gripping members or gripping jaws that may move radially inward and/or radially outward, such as to grip an external surface of the tubular member 111. If so equipped, a counter-torque device, which is typically referred to as a backup, may be used to grip an adjacent tubular member 111 or the tubular string 115 to facilitate making-up and breaking-out connections. Once the pipe wrench has gripped the tubular member 111, the pipe wrench may be used to rotate one tubular member 111 with respect to another to make-up and break-out threaded connections.

The gripping apparatus 107 of the drilling rig 101 can be used to support and suspend the tubular string 115, e.g., by gripping, from the drilling rig 101, e.g., supported by the rig floor 109 or by a rotary table thereof. The gripping apparatus 107 can be disposed within the rig floor 109, such as flush with the rig floor 109, or may extend above the rig floor 109, as shown. As such, the gripping apparatus 107 can be used to suspend the tubular string 115, e.g., while one or more tubular members 111 are connected or disconnected from the tubular string 115. It should be noted that while FIG. 1 generally depicts a land-based system, it is to be recognized that like systems can be operated on offshore rigs and vessels as well.

Figure 2:
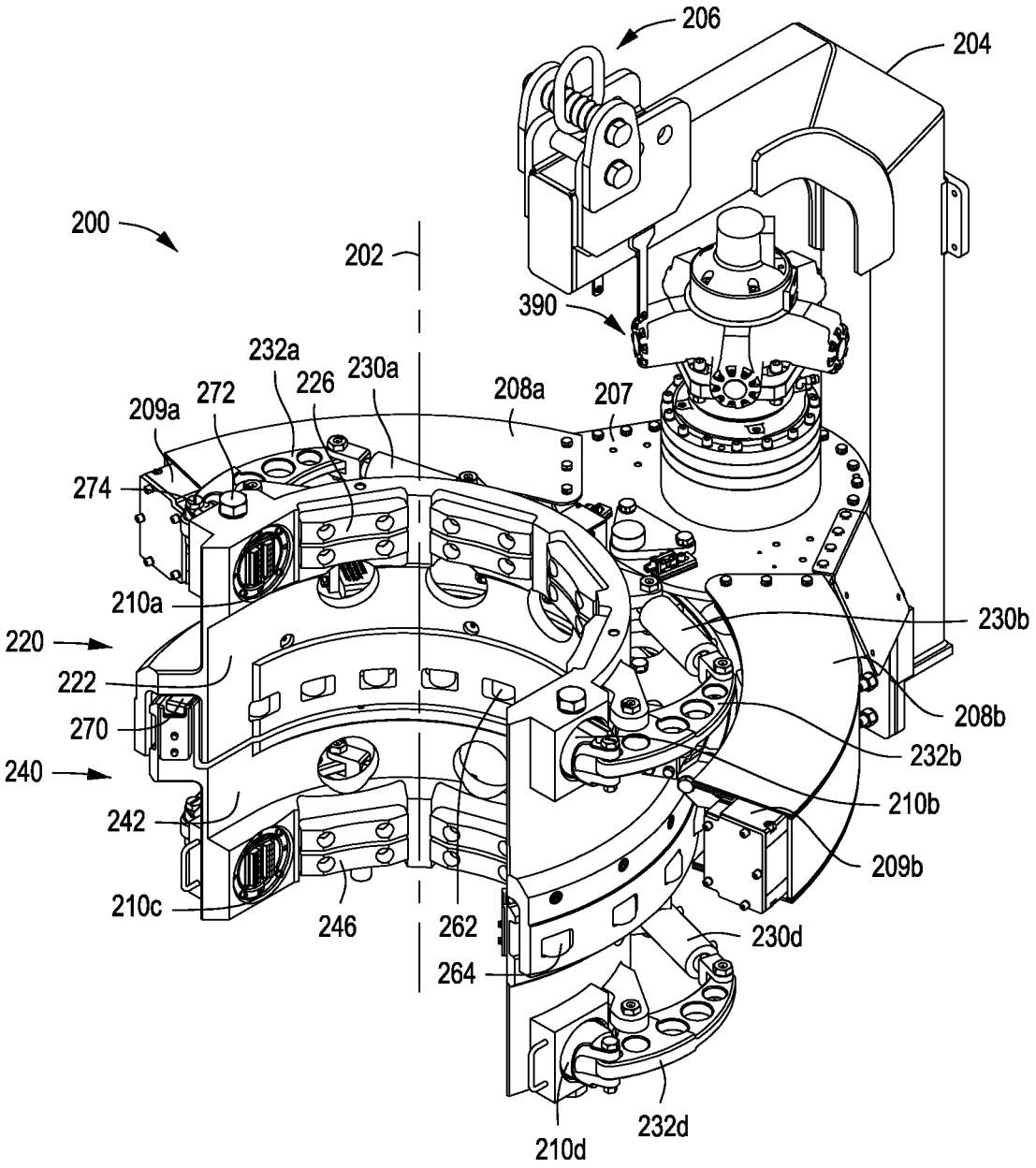
FIGS. 2-3 are perspective views of an automated pipe wrench, according to one or more embodiments.
Figure 3:
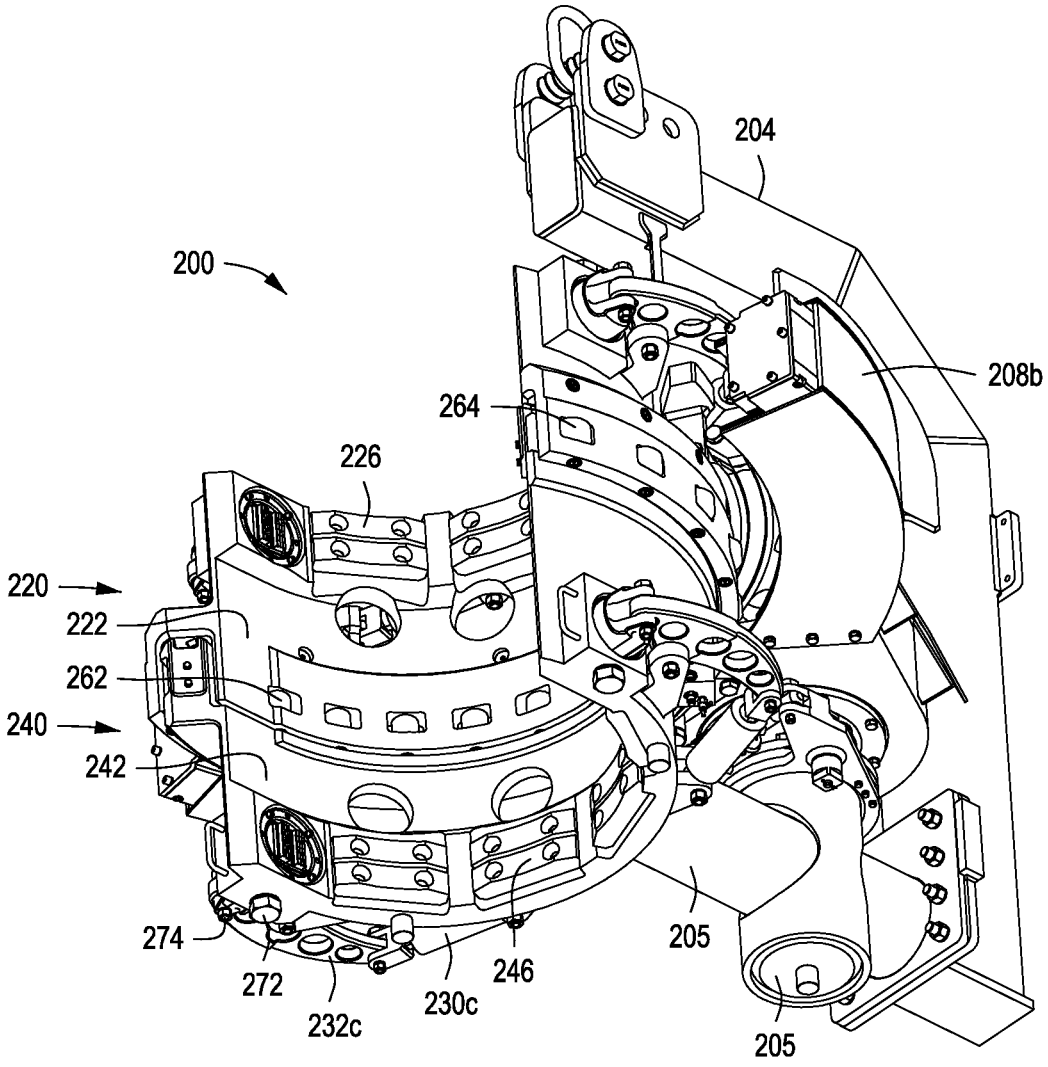

FIGS. 2-3 depict perspective views of a pipe wrench 200 that can be used in the drilling rig 101 to run one or more tubular members 111. More specifically, the pipe wrench 200 can be used to make-up or break-out threaded connections between two tubular members, according to one or more embodiments. The pipe wrench 200 can include an upper wrench assembly 220 configured to grip a first tubular member and a lower wrench assembly 240 configured to grip a second tubular member. The upper and lower wrench assemblies 220, 240 can be configured to rotate the first tubular member relative to the second tubular member, as will be further described below.

The upper wrench assembly 220 can have an upper frame 222 and the lower wrench assembly 240 can have a lower frame 242. The upper and lower frames 222, 242 share a common axis 202 of the upper and lower wrench assemblies 220, 240. The upper and lower wrench assemblies 220, 240 can be concentrically constrained with one another. For example, the upper frame 222 and the lower frame 242 can be concentrically constrained with one another about the common axis 202, as depicted in FIG. 2, such that the axes between the upper frame 222 and the lower frame 242 maintain a co-axial relationship with respect to each other as the frames 222, 242 move with respect to each other. Further, as shown in FIG. 2, the upper frame 222 and the lower frame 242 are coupled to the support frame 204 (e.g., directly or indirectly coupled) to maintain a common axis with respect to each other, and provide a means for vertically supporting the entire automated wrench assembly.

Figure 4:
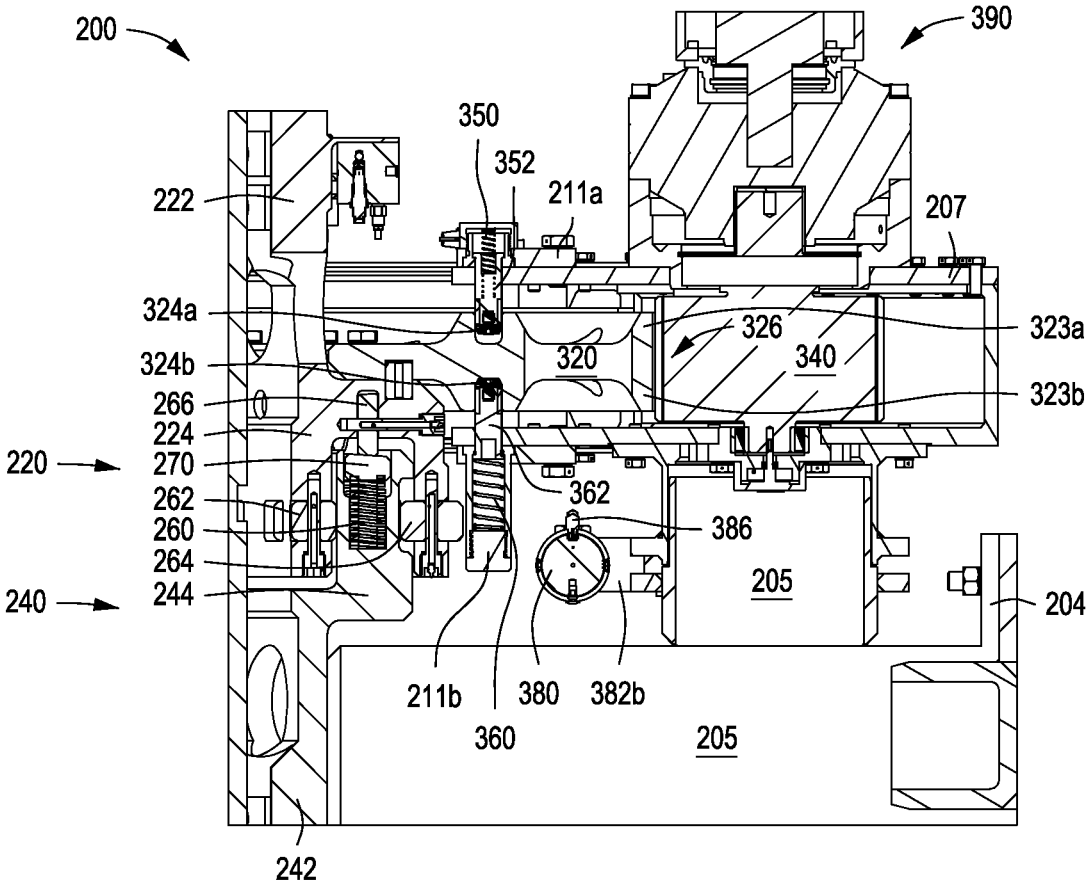
FIG. 4 is a cross-sectional view of the automated pipe wrench, according to one or more embodiments.
Figure 5A:
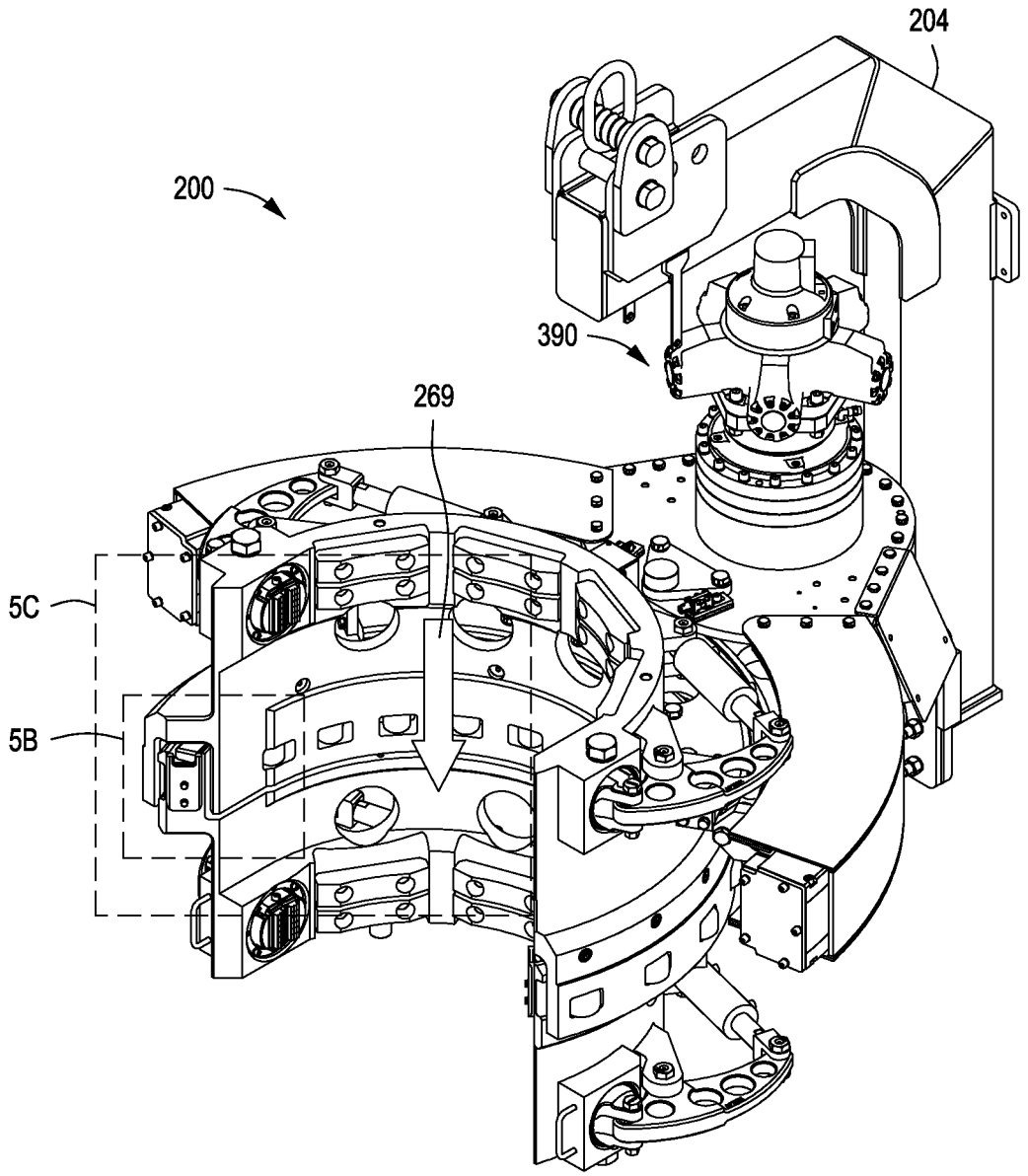
FIG. 5A is another perspective view of the automated pipe wrench, according to one or more embodiments.
Figure 5B:
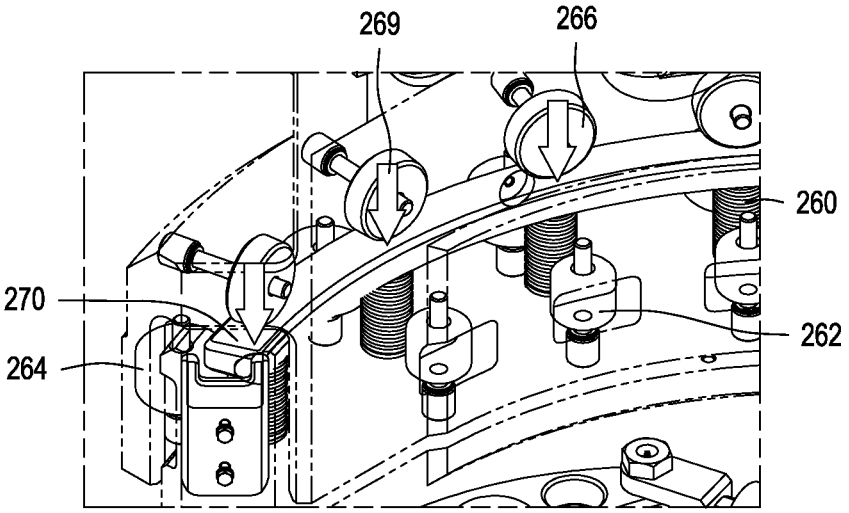
FIG. 5B is a partial view, as designated in FIG. 5A, of a portion of the automated pipe wrench, shown, in part, in phantom, according to one or more embodiments.
Figure 5C:
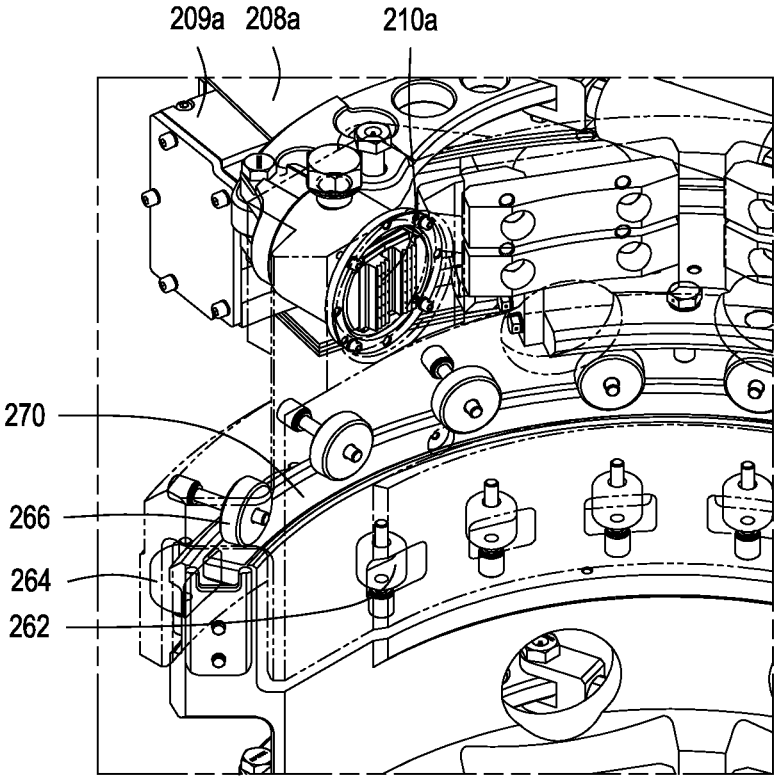
FIG. 5C is a partial view, as designated in FIG. 5A, of another portion of the automated pipe wrench, shown, in part, in phantom, according to one or more embodiments.

The upper and lower wrench assemblies 220, 240 can also be axially overlap and radially engage with one another. For example, a segment 224 of the upper frame 222 and a segment 244 of the lower frame 242 can axially overlap and radially engage with one another. As depicted in FIG. 4, the segment 224 of the upper frame 222 axially overlaps at least partially around the segment 244 of the lower frame 242 and radially engages therewith. In other embodiments, not shown, the segment 244 of the lower frame 242 can axially overlap at least partially around the segment 224 of the upper frame 222 and radially engage therewith.

The upper and lower wrench assemblies 220, 240 can radially engage with one another through a plurality of rotatable members or rollers 262, 264 disposed horizontally or radially between the upper and lower wrench assemblies 220, 240 to limit radial movement of the upper and lower wrench assemblies 220, 240. The plurality of rollers 262, 264 can include an inner set of rollers 262 and an outer set of rollers 264. As shown best in FIG. 4, the rollers 262, 264 may also be positioned to engage with a groove or recess formed within one of the segments 224, 244 of the upper and lower wrench assemblies 220, 240. In this embodiment, as the rollers 262, 264 are positioned on the segment 224 of the upper wrench assembly 220, the segment 244 of the lower wrench assembly 240 may include a groove or recess (e.g., radial) formed therein (not shown), in which the outer rollers 264 may engage the segment 244 within the groove or recess, thereby limiting the range of movement of the outer rollers 264 within the groove or recess.

Referring to FIGS. 2, 3, and 5A-5C, the pipe wrench 200 can also include one or more biasing mechanisms 260 disposed between the upper and lower wrench assemblies 220, 240, such as supported by the lower wrench assembly 240, to bias the upper and lower wrench assemblies 220, 240 vertically away from one another. The upper and lower wrench assemblies 220, 240 axially engage with one another through a plurality of rotatable members or rollers 266 vertically or axially positioned or otherwise disposed between the upper and lower wrench assemblies 220, 240. The rollers 266 facilitate vertical movement of the upper and lower wrench assemblies 220, 240 relative to one another. In some examples, the biasing mechanism 260 can be radially positioned or otherwise disposed between the inner set of rollers 262 and the outer set of rollers 264 that are disposed between the upper and lower wrench assemblies 220, 240.

One or more ring plates 270 can be disposed between the biasing mechanism 260 and the plurality of rollers 262, 264, 266. As shown in FIGS. 4 and 5A-5C, the rollers 266 may be used to engage the ring plate 270 to facilitate rotation between the upper and lower wrench assemblies 220, 240 while still allowing the biasing mechanism 260 to bias the upper and lower wrench assemblies 220, 240 away from one another and support the upper wrench assembly 220. Further, to limit the radial movement of the biasing mechanism 260, the biasing mechanism 260 may be positioned within a groove or recess (e.g., axial) formed within one of the segments 224, 244 of the upper and lower wrench assemblies 220, 240. In this embodiment, as the rollers 266 are positioned on the segment 224 of the upper wrench assembly 220, the segment 244 of the lower wrench assembly 240 may have the groove or recess (e.g., axial) formed therein with the biasing mechanism 260 and the ring plate 270 positioned therein for the rollers 266 to engage the ring plate 270. The rollers 266 transfer downward force, indicated by arrows 269 in FIGS. 5A-5B, to the biasing mechanisms 260 via the ring plate 270.

Each of the pluralities of rollers 262, 264, 266 can independently be or include, but is not limited to, one or more wheels, casters, bearings (e.g., ball bearings and/or cylindrical bearings), rotatable members, or any combination thereof. Accordingly, though the rollers 262, 264, 266 are described as positioned between the upper and lower wrench assemblies 220, 240, the rollers 262, 264, 266 are shown as wheels, and thus may couple to one of the upper or lower wrench assemblies 220, 240 to engage the other.

In another embodiment, not depicted in the Drawings, any one or more of the rollers 262, 264, 266 can independently be replaced or substituted for one or more ridges, one or more pins, one or more other members disposed on the segment 224 of the upper wrench assembly 220. The segment 244 of the lower wrench assembly 240 may include a groove or recess (e.g., radial) formed therein and complimentary to the ridge, pin, or other member for engaging the segment 244 within the groove or recess, thereby limiting the range of movement between the segments 224 and 244 within the groove or recess.

The biasing mechanism 260 can be or include, but is not limited to, one or more springs, pressurized chambers or bladders, or a combination thereof. In some examples, the biasing mechanism 260 can be or include one or more springs, such as a plurality of springs containing a range from 6 springs to about 30 springs.

FIGS. 2-3 depict that the pipe wrench 200 can also include a plurality of gripping members or jaw assemblies 210, for example, a pair of upper jaw assemblies 210*a*, 210*b* and a pair of lower jaw assemblies 210*c*, 210*d*. The pair of upper jaw assemblies 210*a*, 210*b* can be coupled to the upper wrench assembly 220 and configured to grip a first tubular member 180. The pair of lower jaw assemblies 210*c*, 210*d* can be coupled to the lower wrench assembly 240 and configured to grip a second tubular member 182.

In one configuration, the pair of upper jaw assemblies 210*a*, 210*b* can include a first jaw assembly 210*a* opposite of and facing towards a second jaw assembly 210*b*. The first tubular member 180 can be disposed between the upper jaw assemblies 210*a*, 210*b*. A first actuator 230*a* and a first linkage 232*a* can be operably coupled to the first jaw assembly 210*a* and a second actuator 230*b* and a second linkage 232*b* can be operably coupled to the second jaw assembly 210*b*. The first and second jaw assemblies 210*a*, 210*b* can independently be configured to grip the first tubular member 180 via the operation of the first and second actuators 230*a*, 230*b* and the first and second linkages 232*a*, 232*b*.

The pair of lower jaw assemblies 210*c*, 210*d* can include a third jaw assembly 210*c* opposite of and facing towards a fourth jaw assembly 210*d*. The second tubular member 182 can be disposed between the lower jaw assemblies 210*c*, 210*d*. A third actuator 230*c* and a third linkage 232*c* can be operably coupled to the third jaw assembly 210*c* and a fourth actuator 230*d* and a fourth linkage 232*d* can be operably coupled to the fourth jaw assembly 210*d*. The third and fourth jaw assemblies 210*c*, 210*d* can independently be configured to grip the second tubular member 182 via the operation of the third and fourth actuators 230*c*, 230*d* and the third and fourth linkages 232*c*, 232*d*.

The upper and lower wrench assemblies 220, 240 can be concentrically constrained, axially aligned, and axially moveable with one another about the common axis 202. The first and second jaw assemblies 210*a*, 210*b* can be radially disposed on the upper frame 222 of the upper wrench assembly 220 about the common axis 202. The third and fourth jaw assemblies 210*c*, 210*d* can be radially disposed on the lower frame 242 of the lower wrench assembly 240 about the common axis 202.

Each of the first actuator 230*a*, the first linkage 232*a*, the second actuator 230*b*, and the second linkage 232*b* can independently be coupled to the upper frame 222. Also, each of the third actuator 230*c*, the third linkage 232*c*, the fourth actuator 230*d*, and the fourth linkage 232*d* can independently be coupled to the lower frame 242. Each of the pairs of the actuator 230 and the respective linkage 232 can move and operate independently of each other. Further, the actuators 230 and the linkages 232 can couple on one end to the jaw assemblies 210, and only couple to the respective wrench assembly 220, 240 on the other end. In such an embodiment, the actuators 230 and the linkages 232 may thus not couple or be directly connected to other portions of the pipe wrench 200, such as the support frame 204, a gear casing 207, one or more gear guards 208*a*, 208*b*, and/or one or more extendable gear guards 209*a*, 209*b*, discussed more below.

In other embodiments, not depicted, the first and second linkages 232*a*, 232*b* can independently be omitted from the upper wrench assembly 220 and/or the third and fourth linkages 232*c*, 232*d* can independently be omitted from the lower wrench assembly 240. For example, the first actuator 230*a* can be directly or indirectly coupled to the upper frame 222 of the upper wrench assembly 220 and in-line with and operably coupled to the first jaw assembly 210*a*. Similarly, the second actuator 230*b* can be directly or indirectly coupled to the upper frame 222 of the upper wrench assembly 220 and in-line with and operably coupled to the second jaw assembly 210*b*. The third actuator 230*c* can be directly or indirectly coupled to the lower frame 242 of the lower wrench assembly 240 and in-line with and operably coupled to the third jaw assembly 210*c*. Similarly, the fourth actuator 230*d* can be directly or indirectly coupled to the lower frame 242 of the lower wrench assembly 240 and in-line with and operably coupled to the fourth jaw assembly 210*d*.

Figure 6:
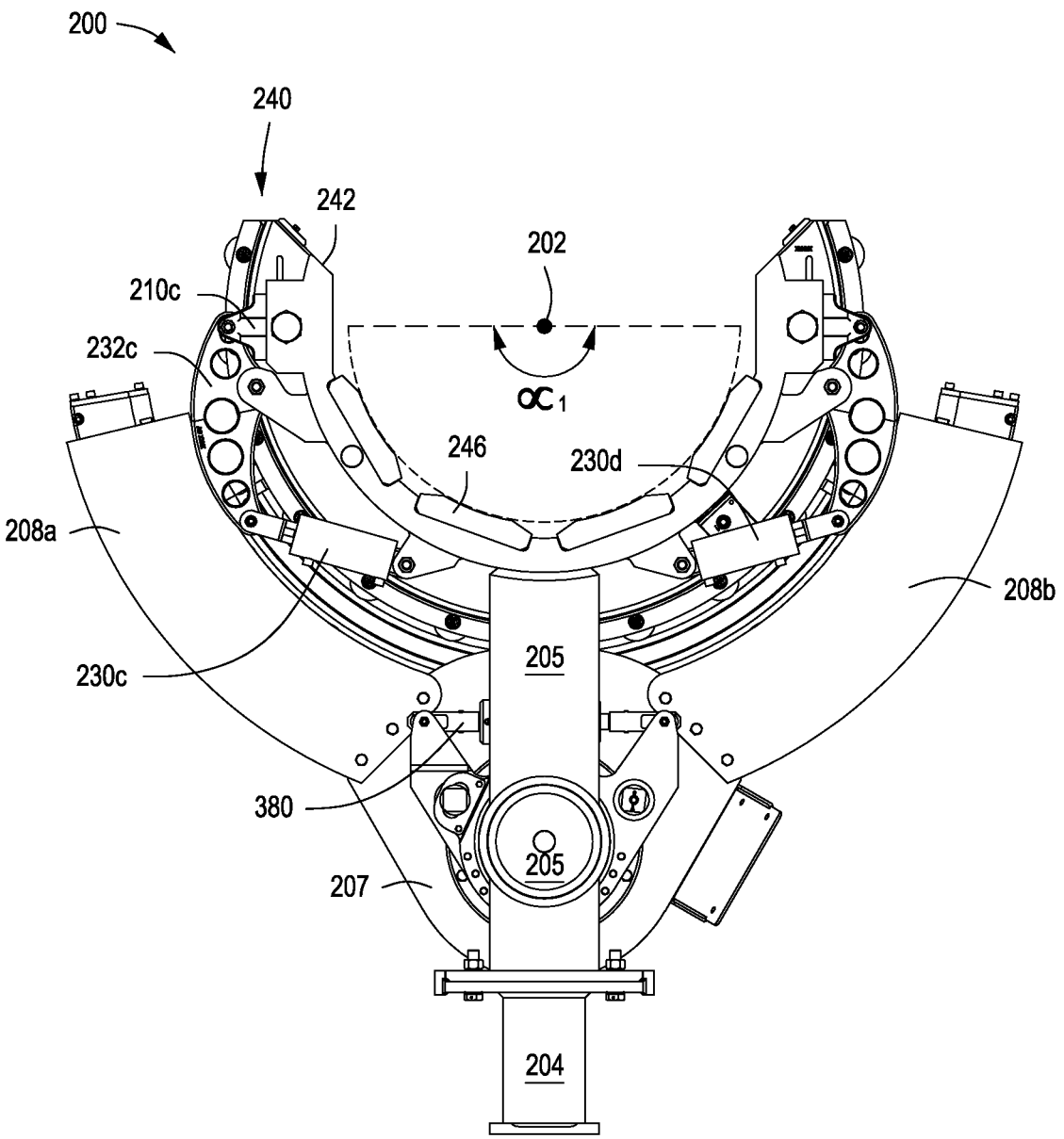
FIG. 6 is a bottom perspective view of the automated pipe wrench, according to one or more embodiments.

FIG. 6 is a bottom perspective view of the pipe wrench 200 such that the lower frame 242 of the lower wrench assembly 240 is shown aligned with and obscuring the upper frame 222 of the upper wrench assembly 220. Each of the upper and lower wrench assemblies 220, 240 can independently have a curved, rounded, or semi-rounded shape within the inner portions that receive tubular members. More specifically, each of the upper and lower frames 222, 242 of the upper and lower wrench assemblies 220, 240 can independently have an arc, such as within a curved, rounded, or semi-rounded segment, about the common axis 202. As such, each of the upper and lower wrench assemblies 220, 240 can independently contain a curved segment containing an arc at an angle $\alpha_1$ about the common axis 202, as depicted in FIG. 6. In one or more configurations, each of the upper and lower wrench assemblies 220, 240 can independently include an arc having angle $\alpha_1$ of about 160° to about 200°.

Each of the actuators 230*a*-230*d* can independently be pressurized to extend the cylinder rod in-line with the respective jaw assembly 210*a*-210*d*. As such, each of the jaw assemblies 210*a*-210*d* is independently forced radially inward into gripping engagement with the first or second tubular member 180, 182. Depressurization of each of the actuators 230*a*-230*d* can independently provide a retraction of the cylinder rod in-line with the respective jaw assembly 210*a*-210*d* and a disengagement of the first or second tubular member 180, 182.

Figure 7:
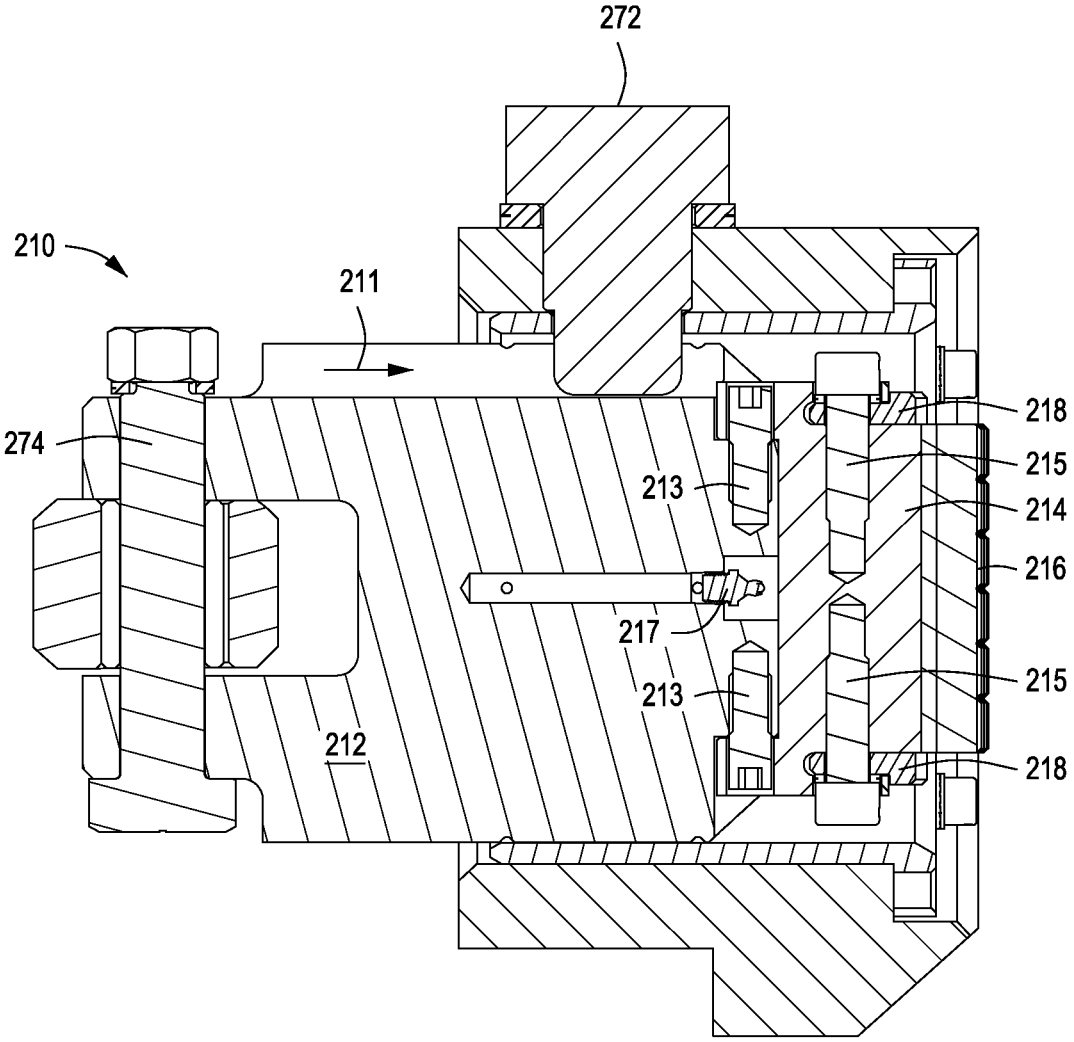
FIG. 7 is a cross-sectional view of a jaw assembly disposed in a portion of the automated pipe wrench, according to one or more embodiments.
Figure 8A:
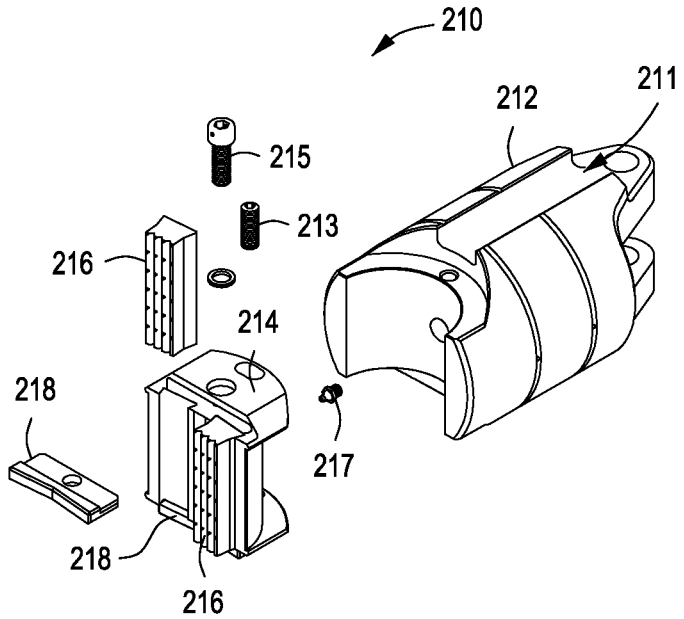
FIGS. 8A-8B are exploded views of the jaw assembly that can be used in the automated pipe wrench, according to one or more embodiments.
Figure 8B:
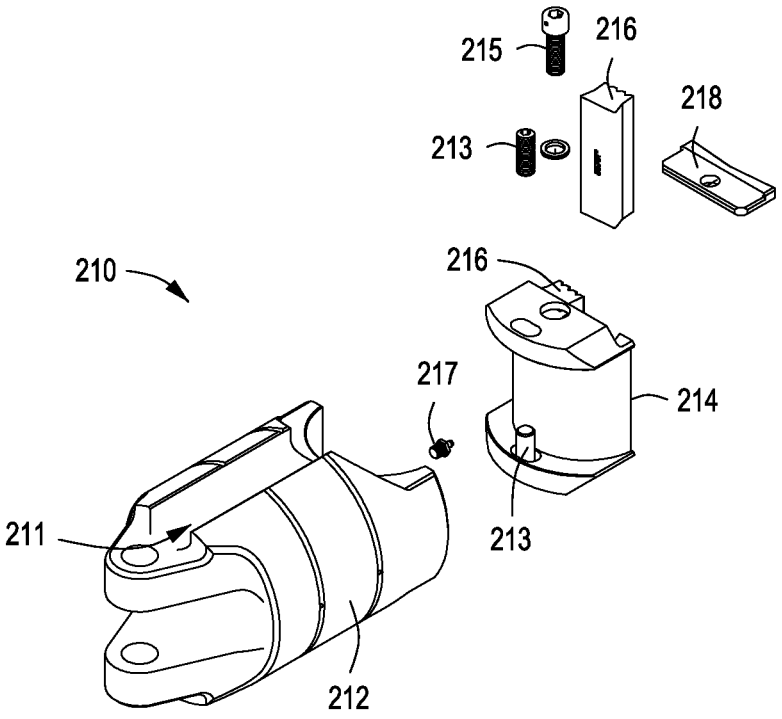

FIG. 7 depicts a cross-sectional view of a jaw assembly 210 disposed in a portion of the pipe wrench 200 and FIGS. 8A-8B depict exploded views of the jaw assembly 210, according to one or more embodiments. Each jaw assembly 210, including the pairs of upper and lower jaw assemblies 210*a*-210*d*, can include, but is not limited to, a jaw body 212, a die carrier 214, one or more dies 216, and one or more caps 217. The dies 216 can be coupled to the die carrier 214 via a dovetail fitting disposed or formed on the front surface of the die carrier 214. Plates 218 (e.g., upper and lower plates) can be attached to the die carrier 214 by one, two, or more fasteners 215 (e.g., bolts, screws, or pins) to secure the dies 216 within the die carrier 214.

The jaw body 212 can be configured to radially move towards and/or away from the first or second tubular member 180, 182. The jaw body 212 can be configured to radially move towards the first or second tubular member 180, 182, such as to be in an engaged position, and to move away from the first or second tubular member 180, 182, such as to be in a disengaged position. The die carrier 214 can be coupled to the jaw body 212 and configured to pivot relative to the jaw body 212. Pivot screws or pins 213 can couple the die carrier 214 and the jaw body 212 together and enable the die carrier 214 to pivot about the pivot screw 213 relative to the jaw body 212.

Each of the dies 216 can be coupled to the die carrier 214 and configured to contact the first or second tubular member 180, 182. The die 216 can be configured to contact the first or second tubular member 180, 182 in the engaged position and configured to break contact with the first or second tubular member 180, 182 when in a disengaged position. Although throughout the Drawings the die carrier 214 is depicted containing two dies 216, each of the die carriers 214 is not limited to having two dies 216, and can have one, two, three, four, or more dies 216 disposed thereon.

A trough or guide 211 can be formed in or is defined by the upper surface of the jaw body 212. For each of the jaw assemblies 210*a*-210*d*, a guide bolt, a rod, a detent, or a pin 272 can be coupled to the upper or lower frame 222 or 242 and can engage the guide 211, thereby enabling only radial movement for the jaw body 212 and all of the components coupled thereto and preventing rotational or axial movement for the jaw body 212. Also, for each of the jaw assemblies 210*a*-210*d*, the jaw body 212 can be coupled to the respective linkage 232*a*-232*d* by one or more fasteners 274 (e.g., a bolt, a detent, or a pin).

As best depicted in FIGS. 2-3, the pipe wrench 200 can also include the support frame 204, a gear casing 207, one or more gear guards 208*a*, 208*b*, and/or one or more extendable gear guards 209*a*, 209*b*. In this embodiment, the support frame 204 can be coupled to the lower wrench assembly 240 and configured to support the lower wrench assembly 240. The support frame 204 can include one or more pipe or conduit portions 205 that are used to support the weight of the pipe wrench 200. The support frame 204 can have one or more connectors 206 for attaching to or otherwise coupling with a cable, a line, a hoist, a lift, an elevator, a top drive, a guiding arm, a tong manipulator arm, or other structure thereby supporting the pipe wrench 200. As such, the pipe wrench 200 can be supported, lifted, positioned, moved, or transported via the connector 206, as depicted in the Drawings. Alternatively, in another example, the pipe wrench 200 can be supported, lifted, positioned, moved, or transported via the support frame 204 connected to a cart or a rail or track system.

The gear casing 207 can be coupled to and between the support frame 204 and the upper wrench assembly 220 and contain at least a portion of a segmented gear 320 disposed therein. One or more compression cylinders 380 can be coupled to and between the upper and lower wrench assemblies 220, 240. In some configurations, the compression cylinder 380 can be directly or indirectly coupled to and between the support frame 204 and the gear casing 207. In other configurations, the compression cylinder 380 can be directly or indirectly coupled to and between the support frame 204 and either the upper or lower wrench assembly 220, 240. As depicted in FIGS. 4, 9, and 10A-10B, the compression cylinder 380 is couple to hinged braces 382*a*, 382*b* that can be attached to the support frame 204 including the conduit portion 205, the gear casing 207, and/or other portions of the upper and lower wrench assemblies 220, 240. The compression cylinder 380 can be or include, but is not limited to, one or more tension and compression cylinders. For example, the compression cylinder 380 can be a tension and compression cylinder that can be used to read tension in a make-up and/or compression in a break-out of a threaded connection.

Figure 10A:
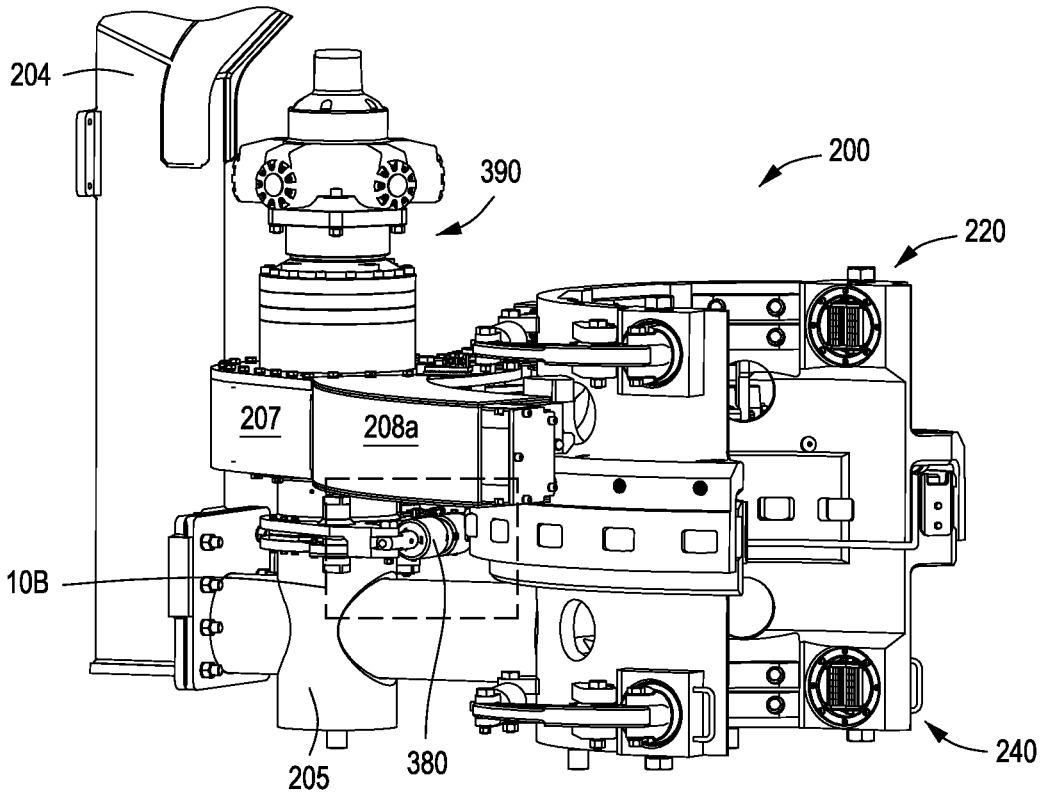
FIG. 10A is a perspective view of the automated pipe wrench, according to one or more embodiments.
Figure 10B:
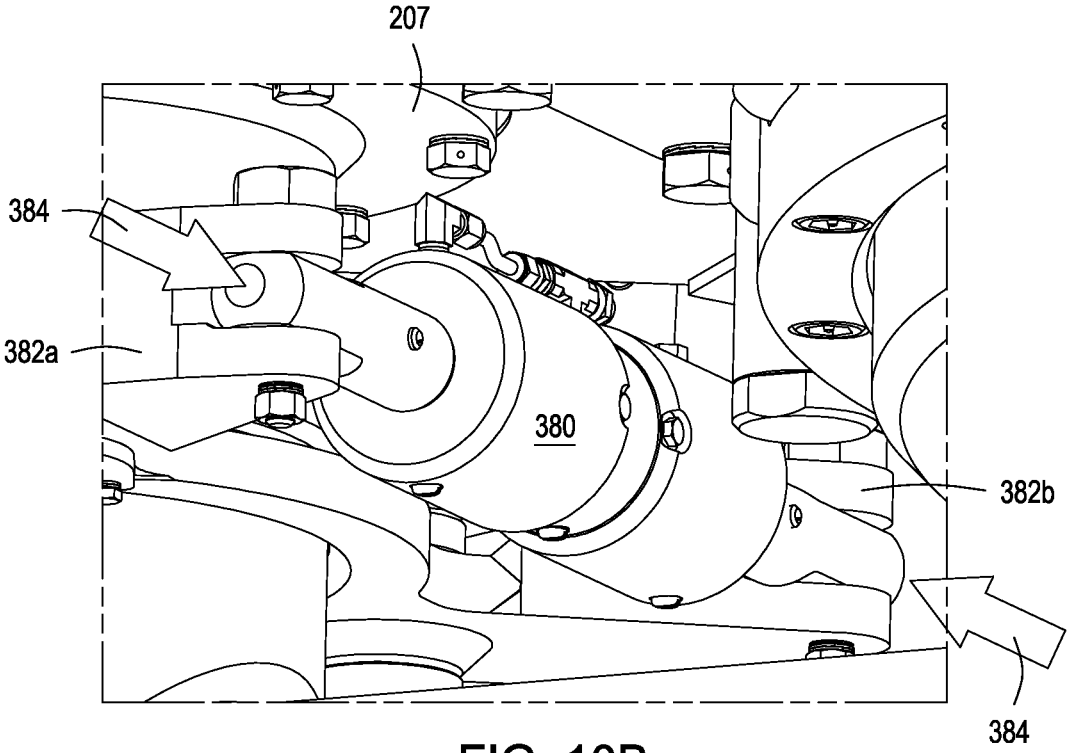
FIG. 10B is a partial view, as designated in FIG. 10A, of a portion of the automated pipe wrench, according to one or more embodiments.

As depicted in FIGS. 4 and 10A-10B, one or more gauges and/or one or more load cells 386 can be coupled to the compression cylinder 380. The load cell 386 can measure or otherwise determine an amount of torque applied to the first or second tubular member 180, 182 via the upper or lower wrench assembly 220, 240. The arrows 384, depicted in FIG. 10B, represent the applied forces to the compression cylinder 380 produced from the relative movements of the upper and/or lower wrench assembly 220, 240. The load cell 386 can be or include one or more hydraulic load cells, pneumatic load cells, electronic load cells, or other type of load cells. In some examples, the pipe wrench 200 can apply torque of up to about 150,000 foot-pounds (ft-lbs) to the first or second tubular member 180, 182 via the upper or lower wrench assembly 220, 240.

The pipe wrench 200 can be used to make-up or break-out threaded connections between two tubular members (e.g., pipes, casings, and/or conduits), such as at a threaded connection 184 between the first tubular member 180 and the second tubular member 182, as depicted in FIGS. 12A-12I and further discussed below. In one or more configurations, the upper wrench assembly 220 can be configured to rotate the first tubular member 180 relative to the second tubular member 182. In other embodiments, not shown, the lower wrench assembly 240 can be configured to rotate the second tubular member 182 relative to the first tubular member 180.

The pipe wrench 200 can be configured to make-up or break-out threaded connections between tubular members that have a variety of different outer diameters. The pipe wrench 200 can be configured to handle tubular members that have an outer diameter of 20 inches or greater.

The pipe wrench 200 can include a plurality of alignment pads 226, 246, such as a plurality of upper alignment pads 226 and/or a plurality of lower alignment pads 246. The plurality of upper alignment pads 226 can be radially disposed on the upper frame 222 of the upper wrench assembly 220 about the common axis 202 and configured to align the first tubular member 180 about the common axis 202. The plurality of lower alignment pads 246 can be radially disposed on the lower frame 242 of the lower wrench assembly 240 about the common axis 202 and configured to align the second tubular member 182 about the common axis 202. The alignment pads 226, 246 can contain or be made from one or more suitable materials, such as one or more plastics (e.g., thermoplastics), one or more rubbers, one or more elastomers, or any mixture thereof. Illustrative materials that are suitable for the alignment pads 226, 246 can include, but are not limited to, one or more polyethylenes, one or more polypropylenes, derivatives thereof, and mixtures thereof. Illustrative polyethylenes can include, but are not limited to, ultra-high-molecular-weight (UHMW) polyethylene, high-modulus polyethylene (HMPE), high-performance polyethylene (HPPE), derivatives thereof, or any mixture thereof.

Figure 9:
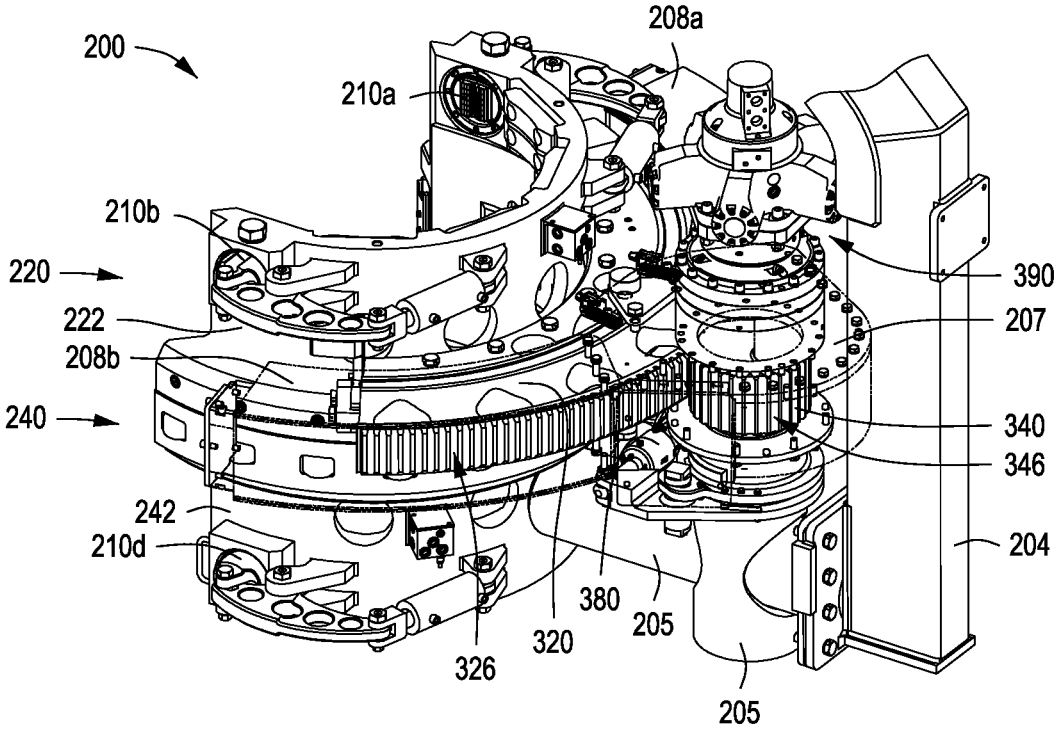
FIG. 9 is a perspective view of the automated pipe wrench, shown, in part, in phantom, according to one or more embodiments.

FIG. 9 is a perspective view of the pipe wrench 200 that depicts the gear guard 208*b* in phantom to better illustrate a segmented gear 320. The pipe wrench 200 can include one or more segmented gears 320 coupled to the upper or lower wrench assembly 220, 240. A plurality of gear teeth 326 can be formed or otherwise disposed in the outer perimeter surface of the segmented gear 320. The segmented gear 320 can be configured to rotate the upper wrench assembly 220 relative to the lower wrench assembly 240. As the upper and lower wrench assemblies 220, 240 rotate relative to one another, the upper and lower wrench assemblies 220, 240 may be able to axially move relative to one another about the axis 202 as the tubular members 180, 182 axially move relative to one another when making-up or breaking-out the threaded connection 184. Accordingly, the segmented gear 320 can be axially and rotationally fixed to one of the upper or lower wrench assembly 220, 240 (e.g., fixed to the upper wrench assembly 220 in this embodiment) such that the segmented gear 320 axially moves along with the upper or lower wrench assembly 220, 240 relative to the other. During this axial movement, the segmented gear 320 can remain engaged with the drive gear 340.

One or more drive gears 340 can be coupled to and between the segmented gear 320 and a drive source 390. The drive gear 340 can have a plurality of gear teeth 346 formed or otherwise disposed in the outer perimeter surface. The gear teeth 346 disposed on the outer perimeter surface of the drive gear 340 can overlap or otherwise engage the gear teeth 326 of the segmented gear 320, as depicted in FIG. 4. The drive source 390 can be or include, but is not limited to, one or more motors (e.g., hydraulic, pneumatic, electric, or combustion), a belt, a gearbox, a transmission, or any combination thereof. The drive gear 340 can be configured to receive power from the drive source 390 to rotate the segmented gear 320, thereby rotating the upper wrench assembly 220 relative to the lower wrench assembly 240. In one or more examples, the drive source 390 can be or include a hydraulic motor.

Referring to FIG. 4, the pipe wrench 200 can include one or more biasing mechanisms 350, 360 to support the segmented gear 320. For example, one or more upper biasing mechanisms 350 and/or one or more lower biasing mechanisms 360 can be disposed adjacent or proximate to the segmented gear 320 and can be configured to support and or buffer the segmented gear 320. The upper biasing mechanism 350 or the lower biasing mechanism 360 can be positioned or otherwise disposed to support the segmented gear 320 within the gear casing 207. Each of the biasing mechanisms 350, 360 can independently be or include, but is not limited to, one or more springs, pressurized chambers or bladders, or a combination thereof.

The upper biasing mechanism 350 can be contained or disposed in a portion 211*a* attached to or formed in the gear casing 207. A rod or a pin 352 can be disposed between the upper biasing mechanism 350 and the segmented gear 320 within the portion 211*a* and can axially engage an upper surface 324*a* of the segmented gear 320. Similarly, the lower biasing mechanism 360 can be contained or disposed in a portion 211*b* attached to or formed in the gear casing 207.

A rod or a pin 362 can be disposed between the lower biasing mechanism 360 and the segmented gear 320 within the portion 211*b* and can axially engage a lower surface 324*b* of the segmented gear 320. The biasing mechanisms 350, 360 and the pins 352, 362 may thus enable axial movement of the segmented gear 320 within the gear casing 207.

Referring to FIGS. 4, 9, and 11A-11C, the segmented gear 320 can include one or more upper ridges 321*a*, 322*a*, and 323*a* and one or more opposite lower ridges 321*b*, 322*b*, and 323*b* disposed thereon. An upper trough or guide can be defined between the upper ridges 321*a* and 322*a* and the upper surface 324*a* of the segmented gear 320. Also, a lower trough or guide can be defined between the lower ridges 321*b* and 322*b* and the lower surface 324*b* of the segmented gear 320. As the segmented gear 320 is engaged and moved by the drive gear 340, the segmented gear 320 can be directed by the pin 352 disposed within the upper trough between the upper ridges 321*a* and 322*a* and the upper surface 324*a* and the pin 362 disposed within the lower trough between the lower ridges 321*b* and 322*b* and the lower surface 324*b*. The pins 352, 362 can also include rollers positioned on an end thereof to facilitate movement of the segmented gear 320. In another aspect, the plurality of gear teeth 326 can be formed or otherwise disposed in the outer perimeter surface of the upper and lower ridges 323*a*, 323*b*.

Figure 11A:
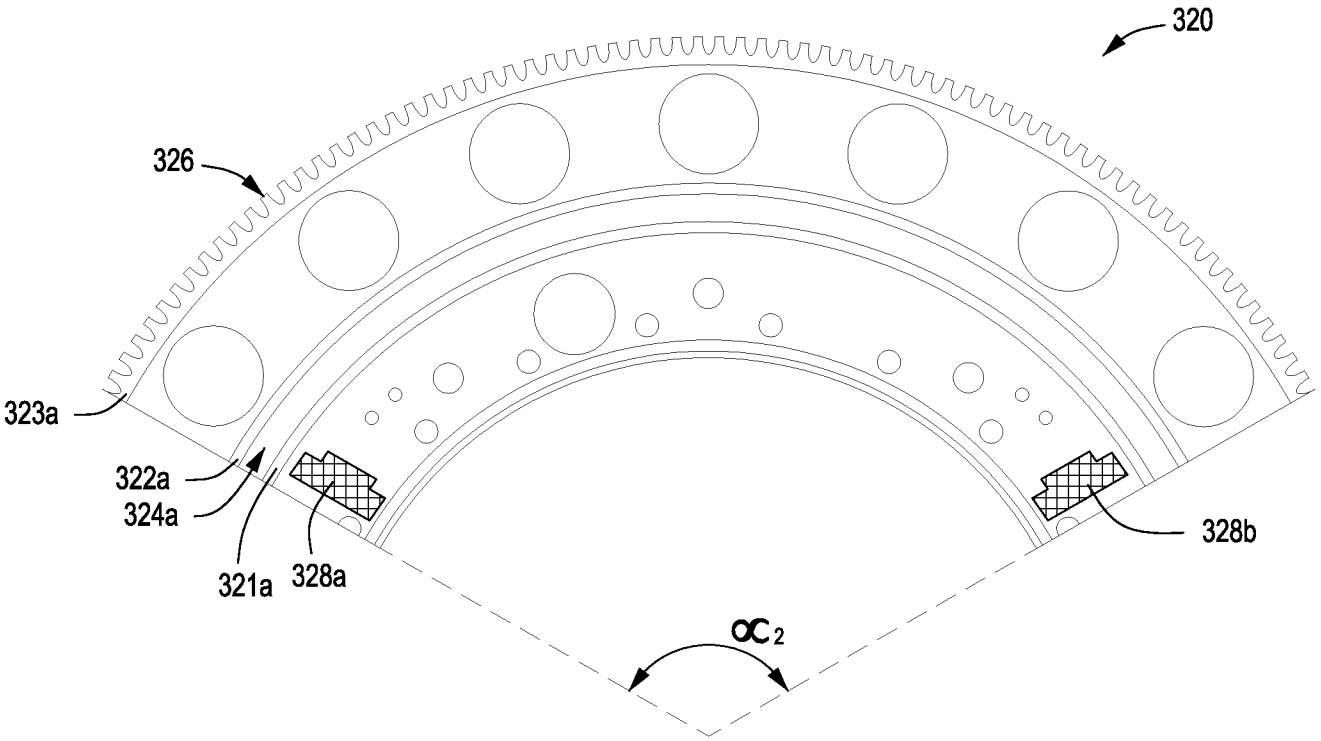
FIGS. 11A-11C are schematic views of a segmented gear that can be used in the automated pipe wrench, according to one or more embodiments.
Figure 11B:
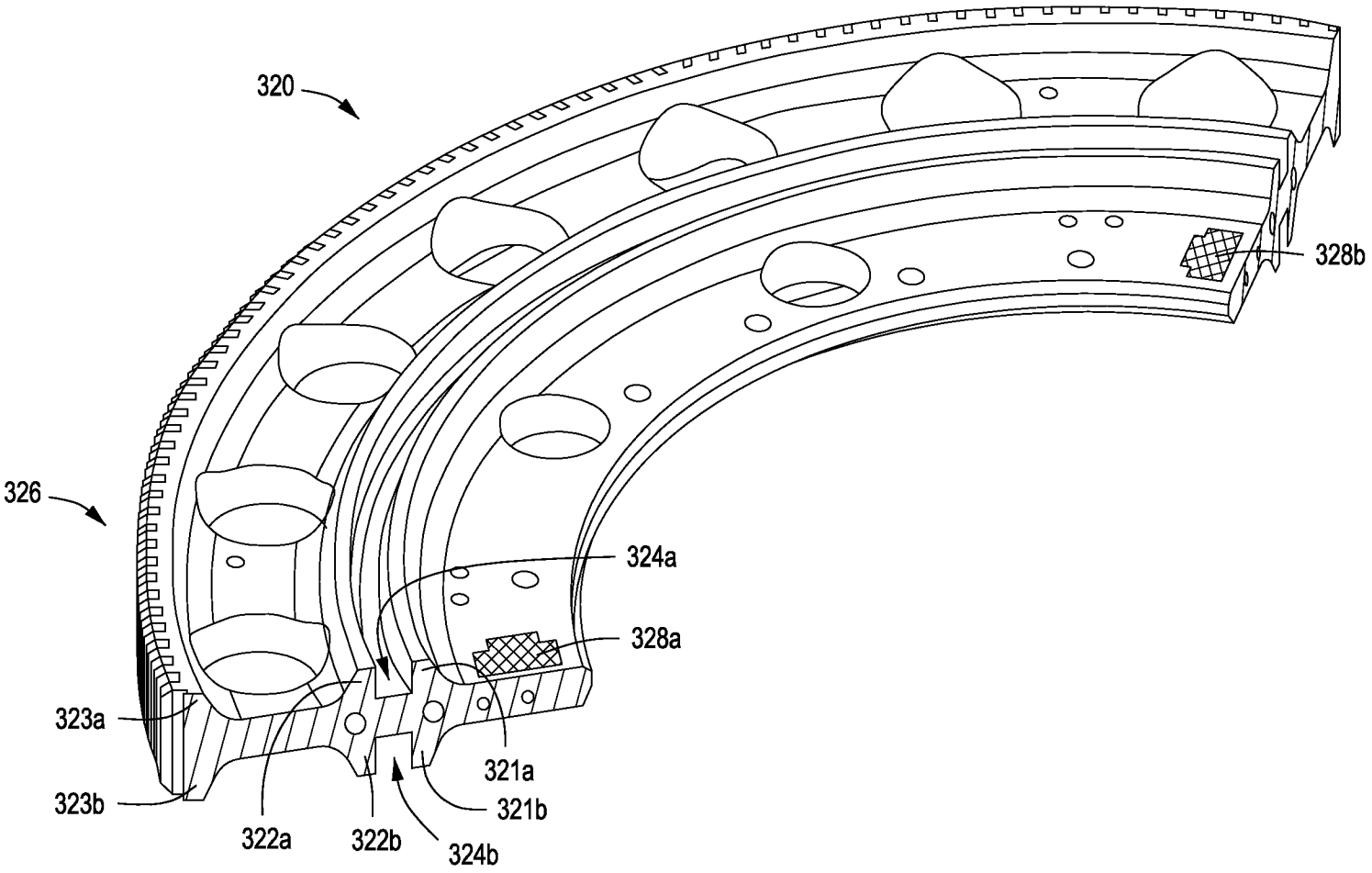
Figure 11C:
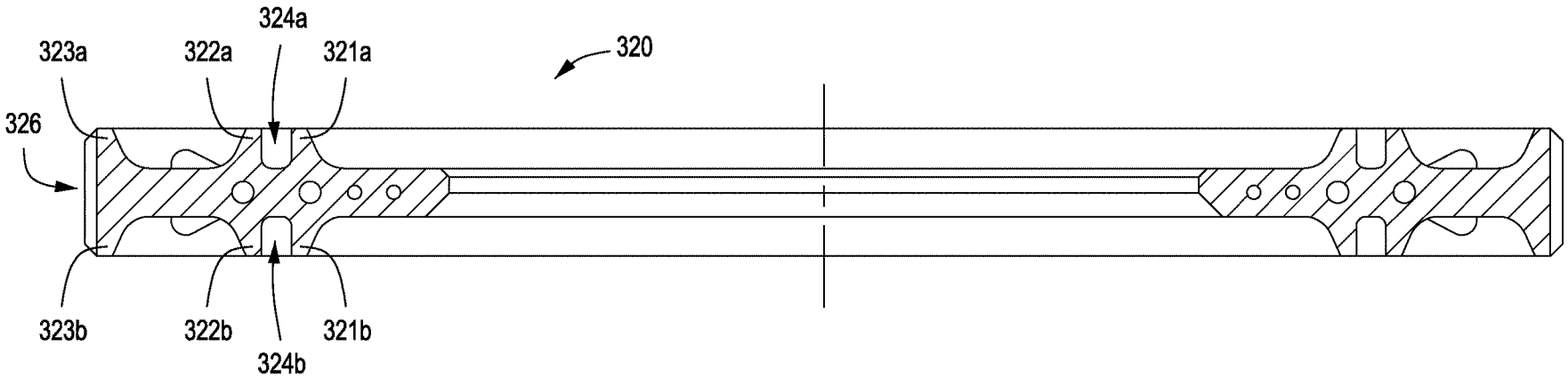

In another embodiment, the segmented gear 320 is part of the drive interface of the pipe wrench 200 that can generate a limited arc of rotational movement or an angle of rotation between the upper and lower wrench assemblies 220, 240 (e.g., the upper wrench assembly 220 relative to the lower wrench assembly 240 or vice versa). The segmented gear 320 can include two or more bumpers or stops 328*a*, 328*b*, as depicted in FIGS. 11A-11B. The stops 328*a*, 328*b* can be disposed on the upper surface of the segmented gear 320. Each stop 328*a*, 328*b* can be configured to engage a pin, a block, or another object coupled to and inside of the gear casing 207 and/or the gear guards 208*a*, 208*b*. The stops 328*a*, 328*b* can limit the angle of rotation between the upper and lower wrench assemblies 220, 240, thereby correlating to the angle of rotation that the upper and lower wrench assemblies 220, 240 can be configured to rotate the first tubular member 180 relative to the second tubular member 182.

The segmented gear 320 can have an arc, such as within a curved, rounded, or semi-rounded segment or portion. The segmented gear 320 can contain an arc at an angle $\alpha 2$, as depicted in FIG. 11A. The arc of the segmented gear 320 can have an angle $\alpha 2$ of about 75° to about 190°. In some configurations, the arc of the segmented gear 320 can have an angle $\alpha 2$ of about 180° and the bumpers or stops 328*a*, 328*b* provide an angle of rotation of less than 180°. In other configurations, the arc of the segmented gear 320 can have the angle $\alpha 2$ of about 120° and the bumpers or stops 328*a*, 328*b* provide an angle of rotation of less than 120°. The angle of rotation between the upper and lower wrench assemblies 220, 240 can be 180° or less, such as, for example, in a range from about 75° to about 180°.

Referring to FIGS. 12A-12I, the pipe wrench 200 is depicted at different stages of making-up or breaking-out the threaded connection 184 between the tubular members 180, 182, according to one or more embodiments. During the various stages of making-up or breaking-out the threaded connection 184, the upper and lower wrench assemblies 220, 240 are concentrically constrained with one another, as depicted throughout FIGS. 12A-12I.

Figure 12A:
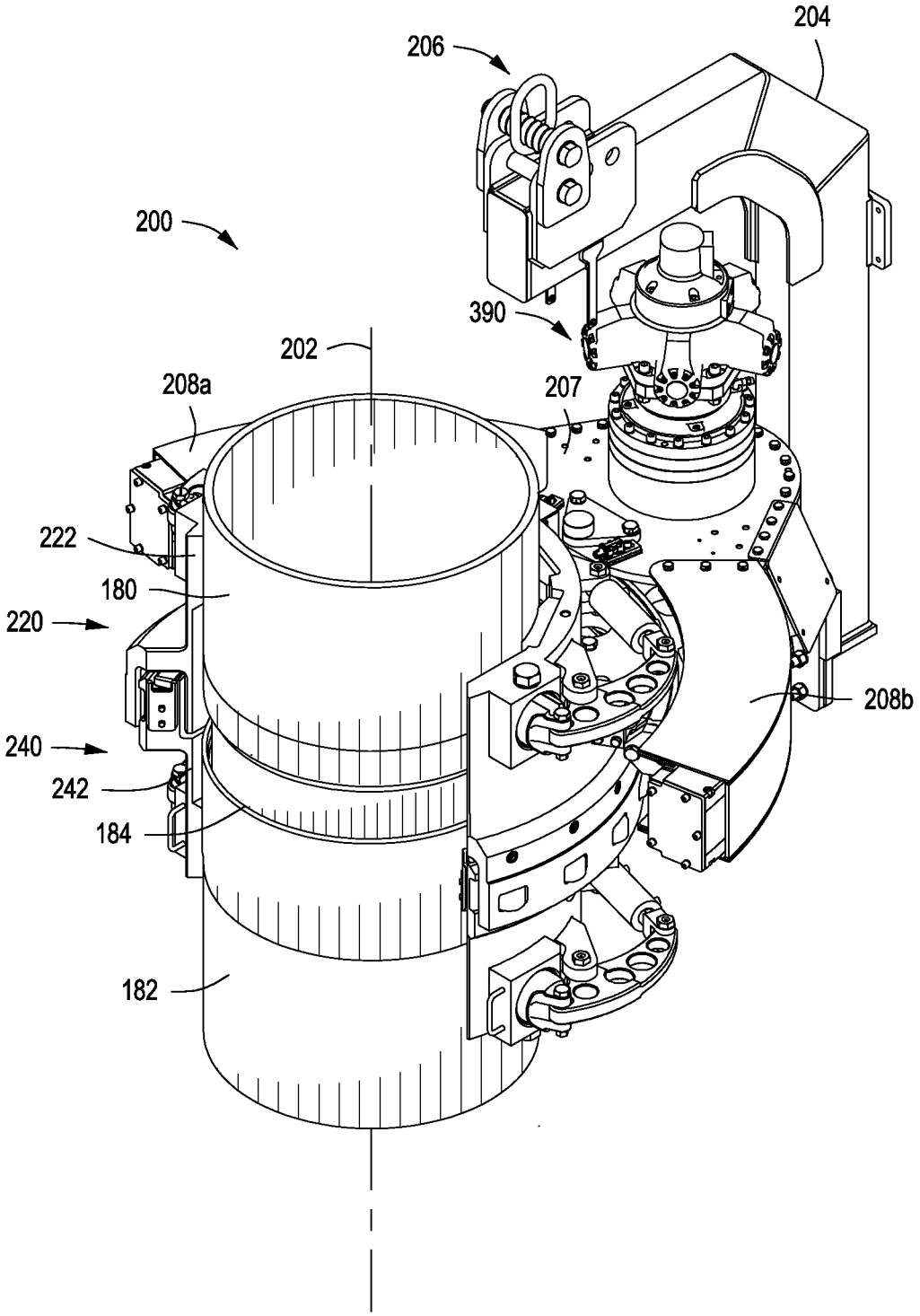
FIGS. 12A-12I are schematic views of the automated pipe wrench at different stages of making-up or breaking-out a threaded connection between two tubular members, according to one or more embodiments.

FIG. 12A depicts the pipe wrench 200 to the center of the well in a disengaged position with the tubular members 180, 182 having a threaded connection 184. None of the dies 216 on the upper or lower jaw assemblies 210*a*, 210*b*, 210*c*, 210*d* are engaged or in contact with the tubular members 180, 182. The upper and lower wrench assemblies 220, 240 and the tubular members 180, 182 are aligned via the common axis 202 of the pipe wrench. The alignment pads 226, 246 can be used to center the pipe wrench 200 onto the pipe body to be gripped, such as the tubular members 180, 182. Various tubular or pipe diameters can be accommodated by swapping out alignment pads 226, 246 of different thicknesses. For example, thicknesses of the alignment pads 226, 246 are configured to contact the tubular members 180, 182 based on a diameter of respective the tubular members 180, 182.

Figure 12B:
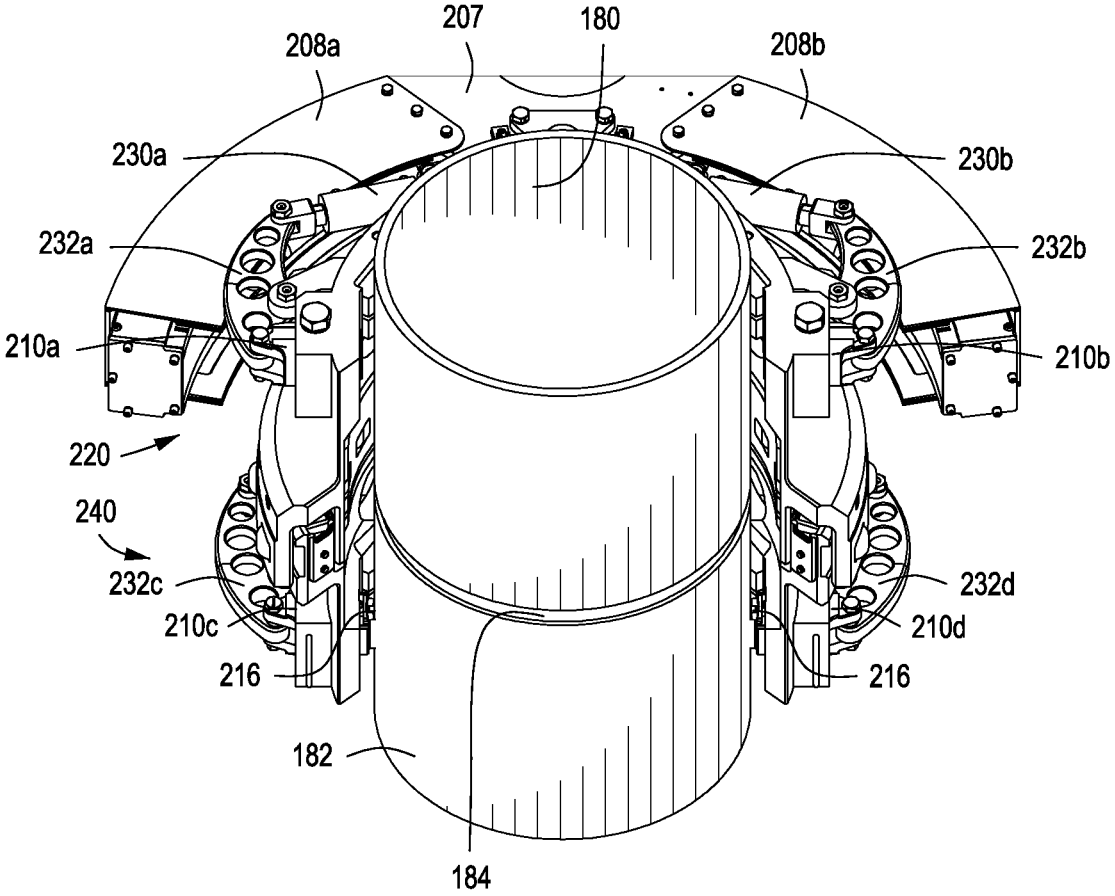

FIG. 12B indicates that the dies 216 on the pair of upper jaw assemblies 210*a*, 210*b* disposed on the upper wrench assembly 220 are still disengaged or not gripping the first tubular member 180. The dies 216 on the pair of lower jaw assemblies 210*c*, 210*d* disposed on the lower wrench assembly 240 are engaged or gripping the second tubular member 182. Although not shown, a spider can be used to hold the lower pipe string, which can include the second tubular member 182, in a vertical position. Various tubular or pipe diameters can be accommodated by using different thicknesses of the die carrier 214 and/or the dies 216 (also depicted in FIGS. 8A and 8B). For example, a thickness of the die carrier 214 is determined or otherwise configured for contacting the tubular members 180, 182 based on a diameter of the tubular members 180, 182.

Figure 12C:
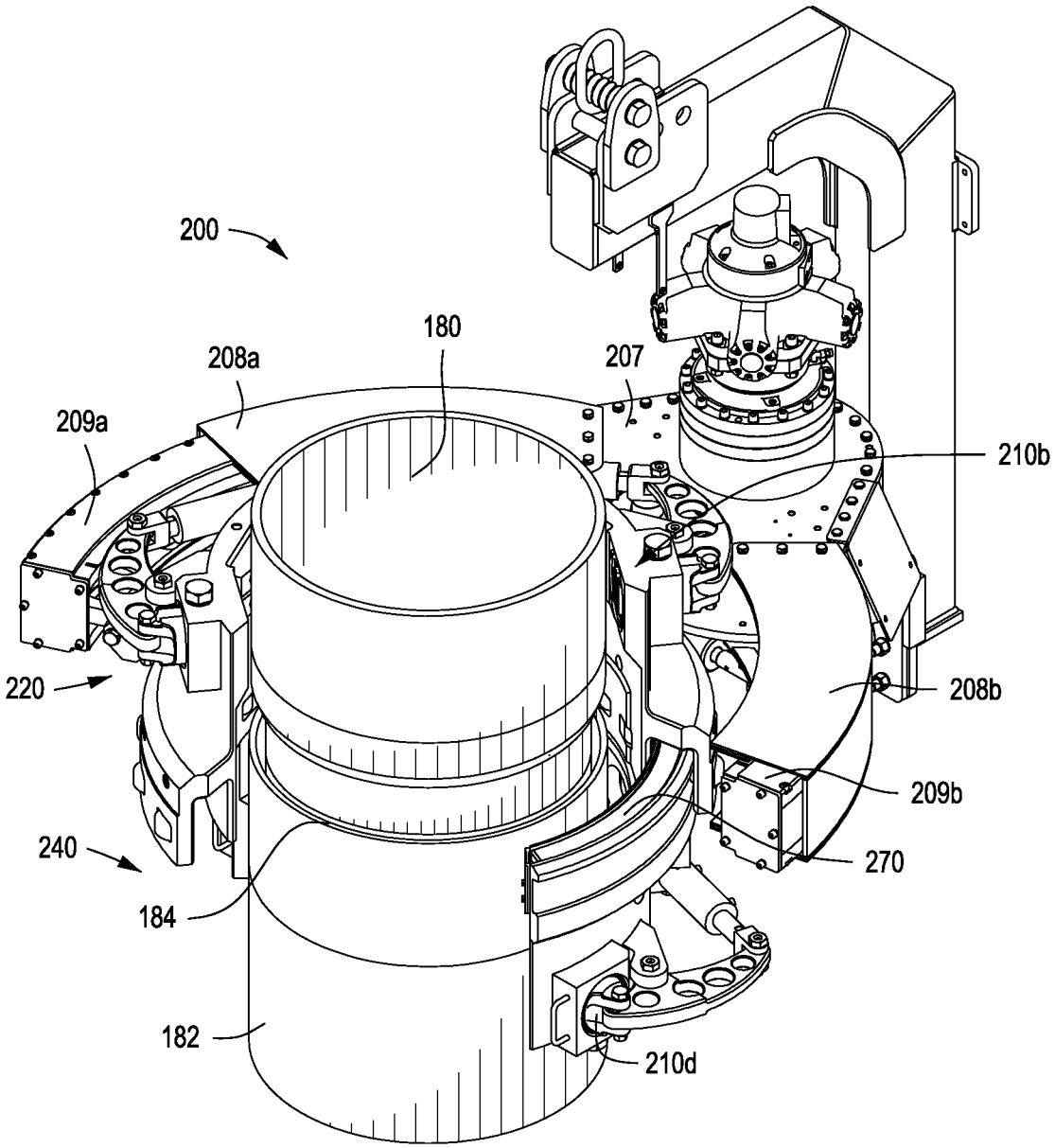
Figure 12D:
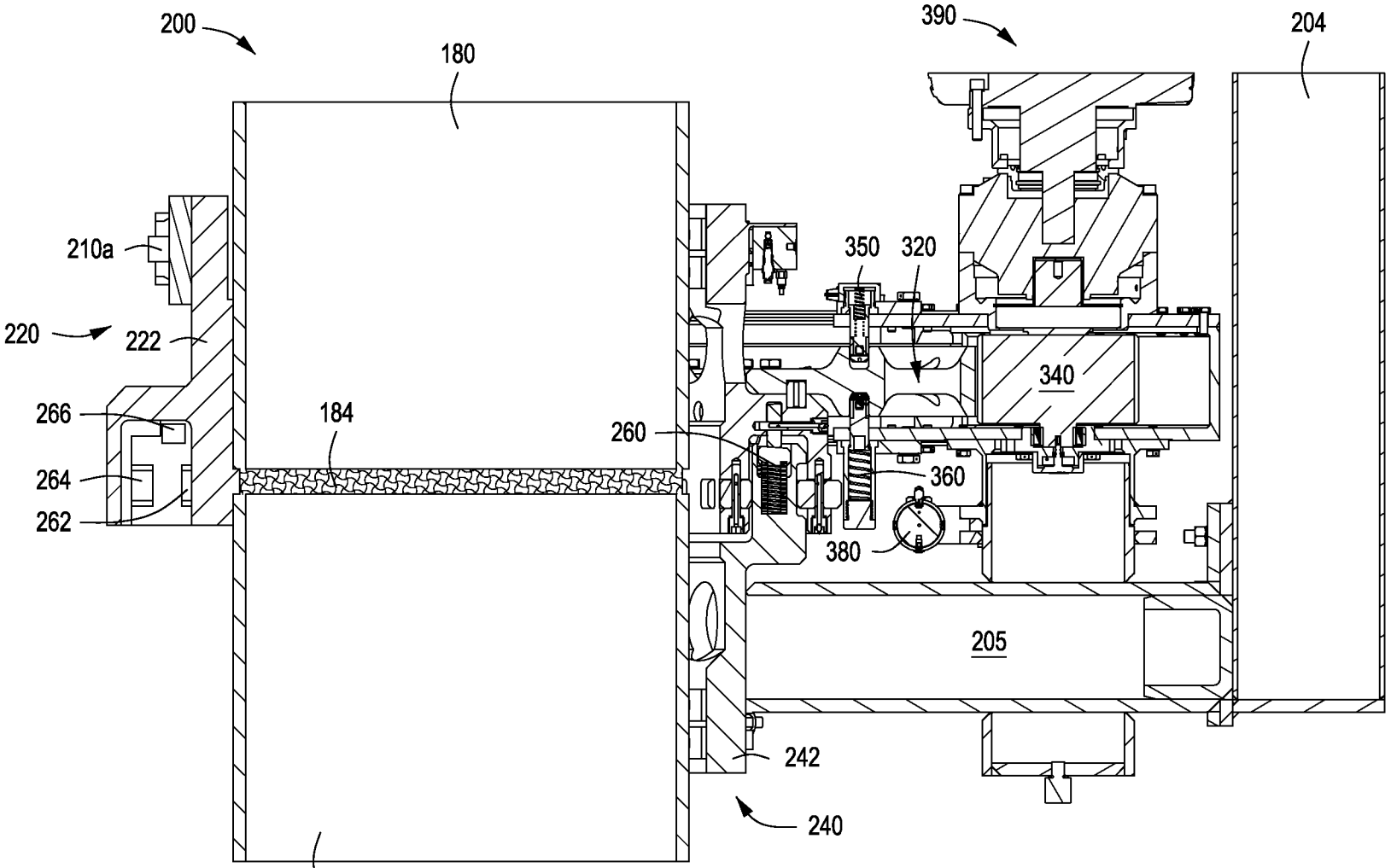

FIGS. 12C-12D indicate that the dies 216 on the pair of upper jaw assemblies 210*a*, 210*b* disposed on the upper wrench assembly 220 are still disengaged or not gripping the first tubular member 180. The dies 216 on the pair of lower jaw assemblies 210*c*, 210*d* disposed on the lower wrench assembly 240 are engaged or gripping the second tubular member 182. The hydraulic motor is activated and rotates the upper wrench assembly 220 with respect to the lower wrench assembly 240 from a neutral position into a position for maximum wrench rotation (e.g., maximum counter-clockwise position for the upper wrench assembly 220 when viewing the wrench 200 top down). The biasing mechanism 260 (e.g., internal compression springs) floats the upper wrench assembly 220 in a neutral position relative to the lower wrench assembly 240 to allow for axial movement (e.g., down from make-up, up for break-out).

Figure 12E:
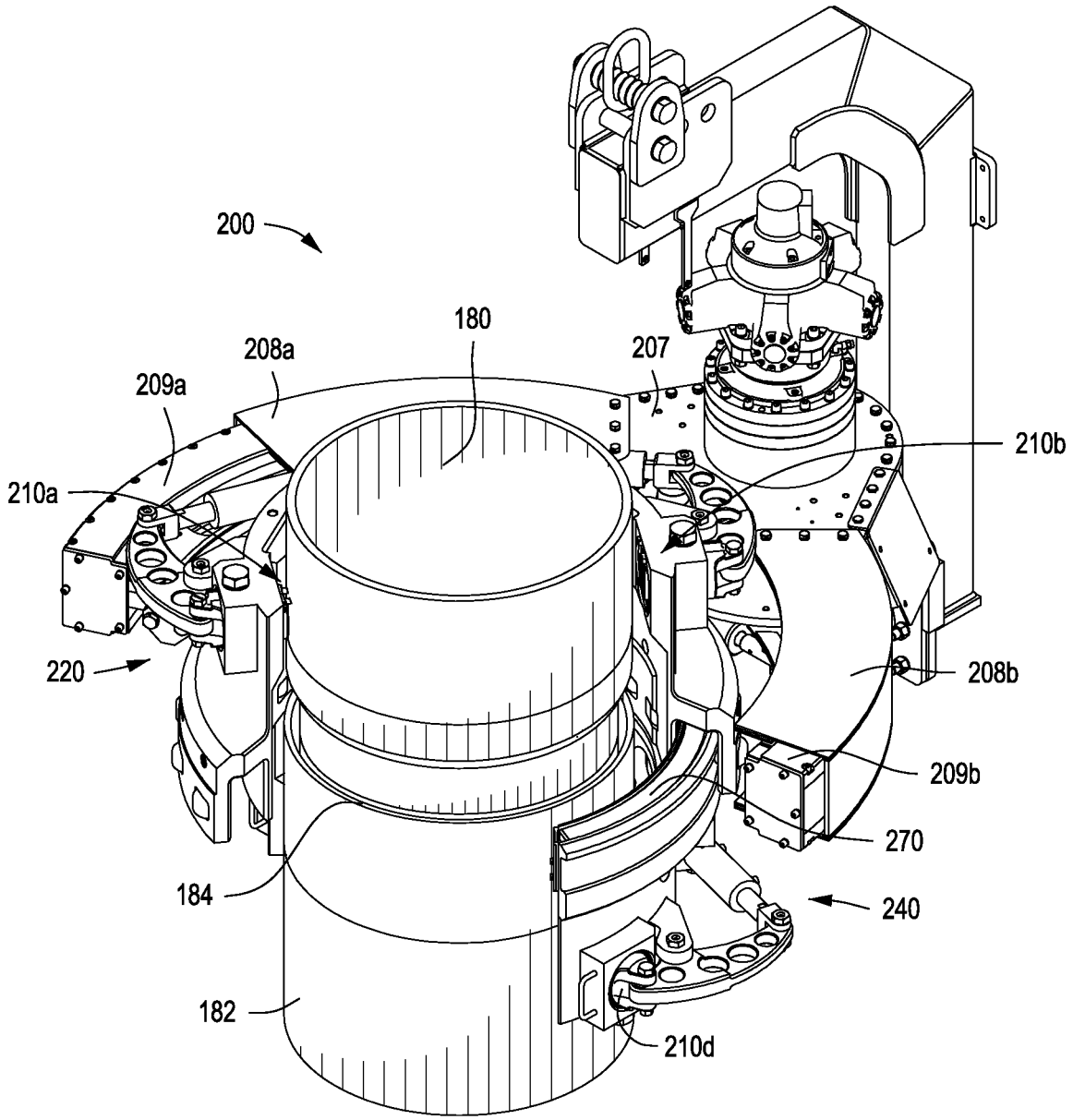

FIG. 12E indicates that the dies 216 on the pair of upper jaw assemblies 210*a*, 210*b* disposed on the upper wrench assembly 220 are now engaged and gripping the first tubular member 180. The dies 216 on the pair of lower jaw assemblies 210*c*, 210*d* disposed on the lower wrench assembly 240 are also engaged or gripping the second tubular member 182.

Figure 12F:
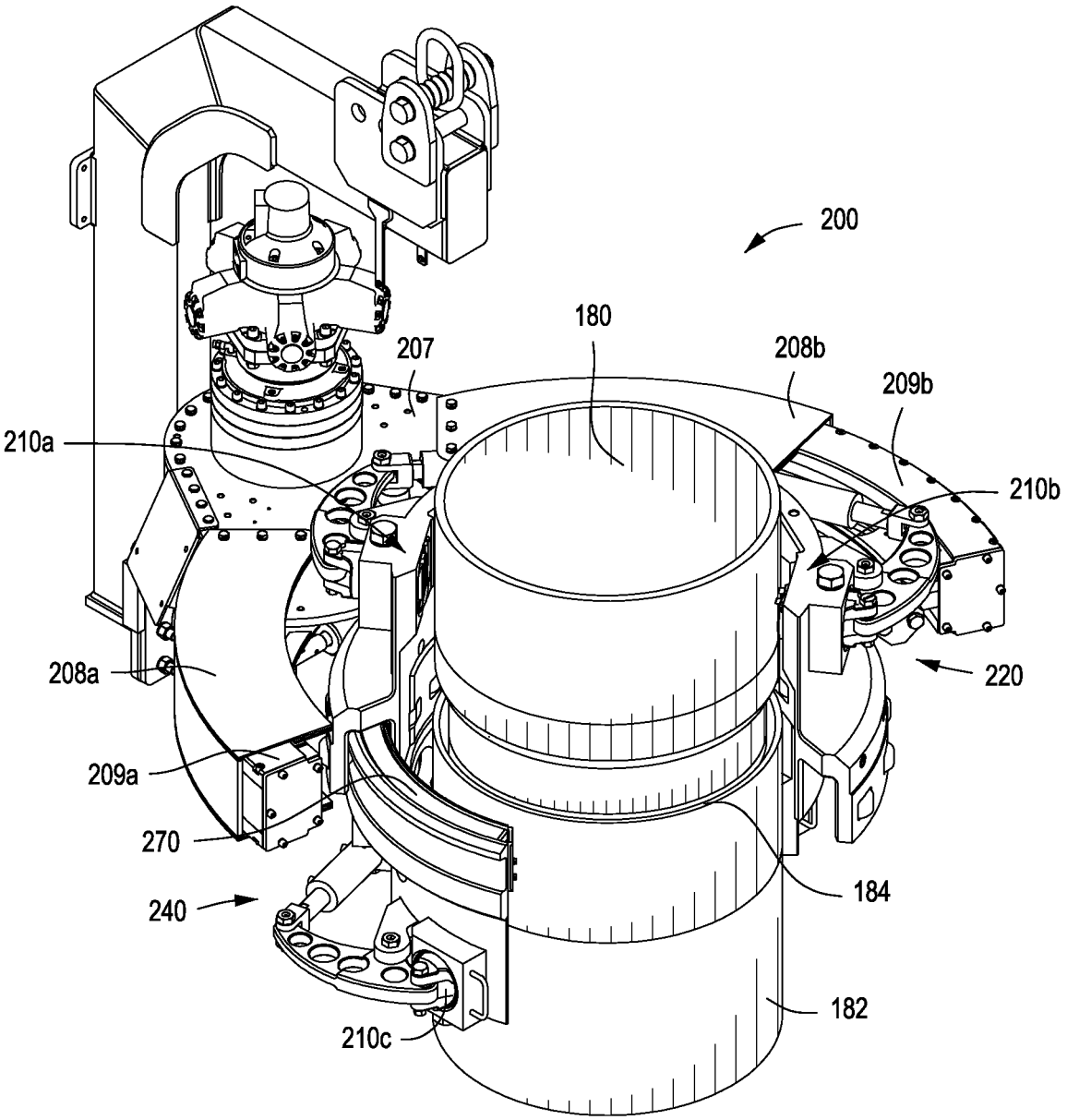
Figure 12G:
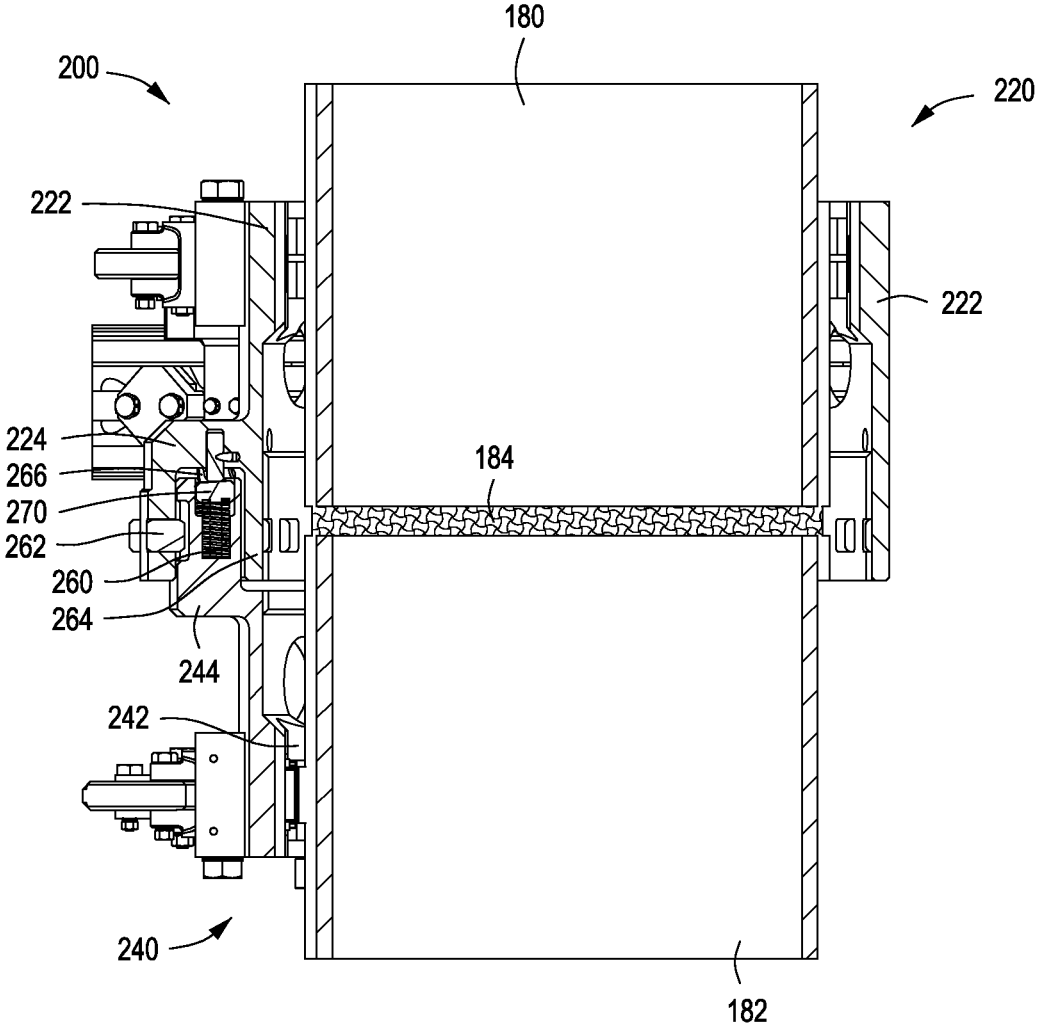

FIGS. 12F-12G indicate that the dies 216 on the pair of upper jaw assemblies 210*a*, 210*b* disposed on the upper wrench assembly 220 are still engaged and gripping the first tubular member 180, and the dies 216 on the pair of lower jaw assemblies 210*c*, 210*d* disposed on the lower wrench assembly 240 are also engaged or gripping the second tubular member 182. The hydraulic motor is activated and rotates the upper wrench assembly 220 and the first tubular member 180 with respect to the lower wrench assembly 240 to the rotation limit (e.g., into a maximum clockwise position for the upper wrench assembly 220 when viewing the wrench 200 top down). As the first tubular member 180 is rotated, the biasing mechanism 260 (e.g., internal compression springs) allows for axial movement of the system (e.g., the upper wrench assembly 220 and the first tubular member 180) to compensate for make-up loss (or break-out gain) due to the helix angle of the threads.

Figure 12H:
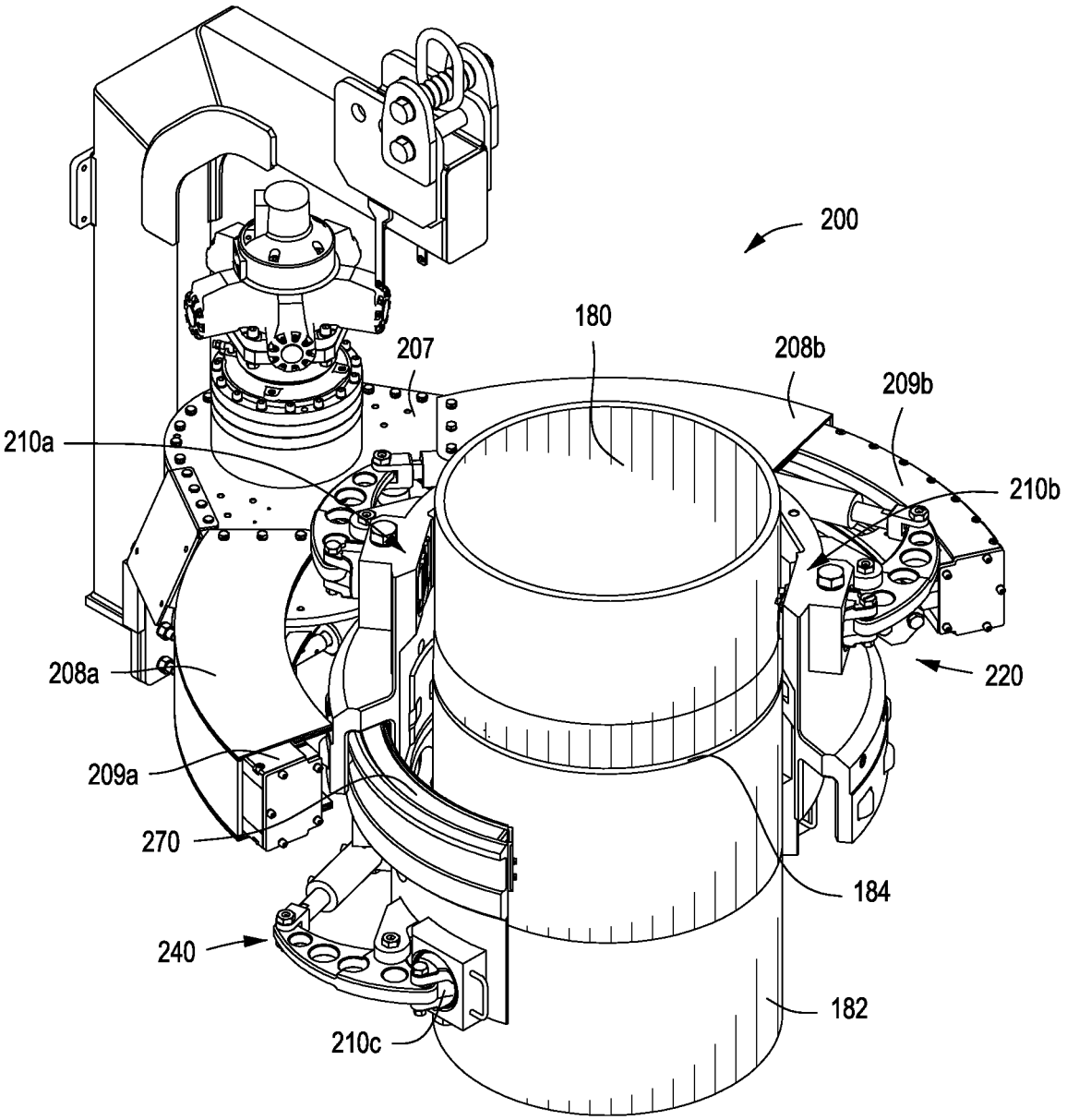

FIG. 12H indicates that the dies 216 on the pair of upper jaw assemblies 210*a*, 210*b* disposed on the upper wrench assembly 220 are now disengaged or not gripping the first tubular member 180. The dies 216 on the pair of lower jaw assemblies 210*c*, 210*d* disposed on the lower wrench assembly 240 are still engaged or gripping the second tubular member 182. This sequence is repeated until the threaded connection 184 of the tubular members 180, 182 is tightened or loosened to the desired torque.

Figure 12I:
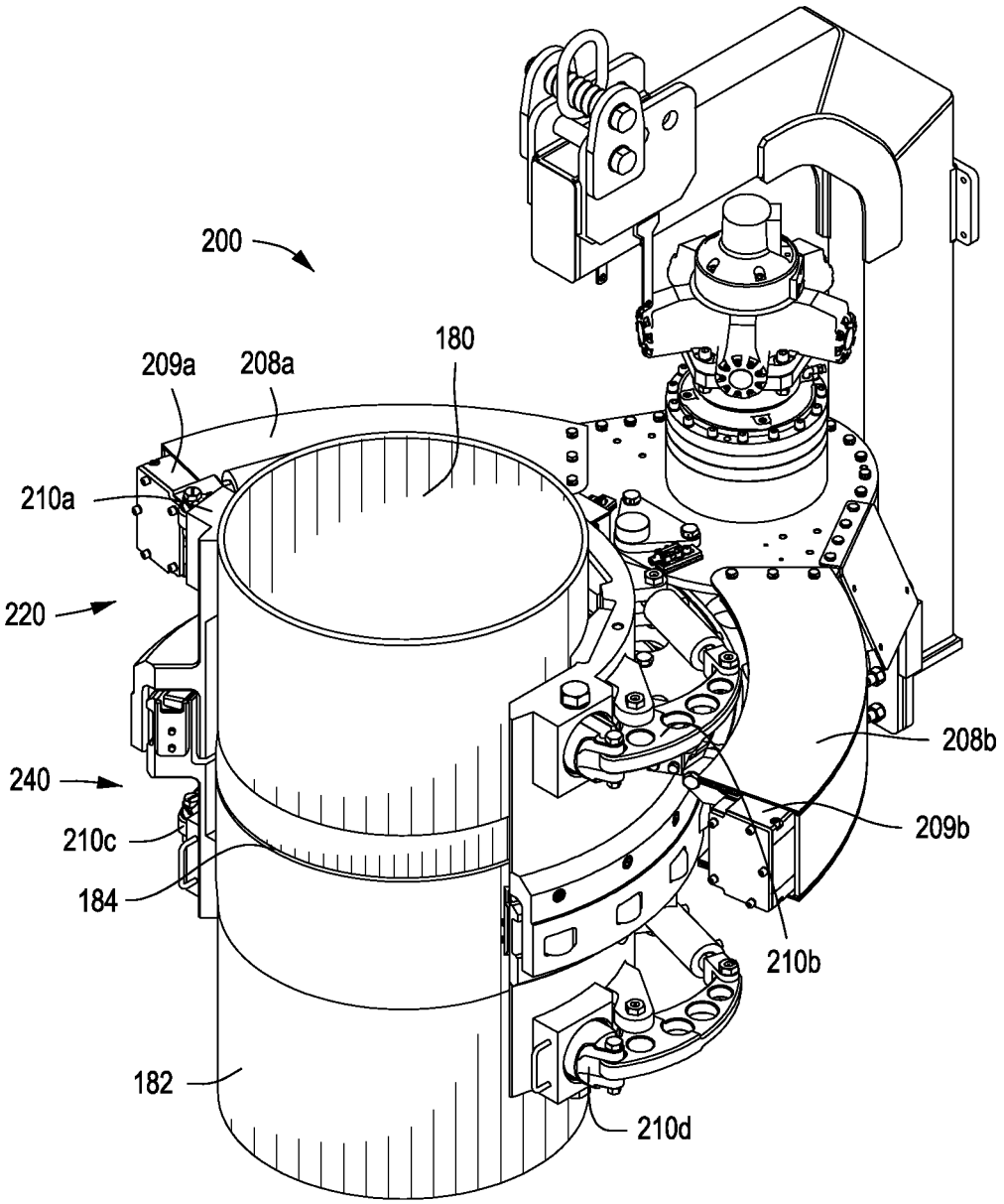

FIG. 12I indicates that the motor was activated to return the upper wrench assembly 220 to align with the lower wrench assembly 240, such as back into a neutral position when receiving the tubular members 180, 182 into the wrench 200 or removing the tubular members 180, 182 therefrom. The pipe wrench 200 is in a disengaged position, as none of the dies 216 on the upper or lower jaw assemblies 210*a*, 210*b*, 210*c*, 210*d* are engaged or in contact with the tubular members 180, 182.

Large OD threaded connections, such as the threaded connection 184 of the tubular members 180, 182, need only a portion of a rotation to be connected (make-up) or disconnected (break-out) by the pipe wrench 200. The pipe wrench 200 is a hybrid device that incorporates some of the features of a power tong into a purpose built machine that is capable of making-up large tubular members having an outer diameter of about 20 inches or greater, such as, for example, about 20 inches to about 30 inches, about 26 inches to about 38 inches, and/or about 30 inches to about 48 inches, which uses only a portion of a rotation for full make-up. The pipe wrench 200 eliminates many of the hazards of making-up large diameter threaded connections that otherwise can be made by using two manual tongs connected to snub lines and winch lines traversing the rig floor. The pipe wrench 200 can make-up large OD threaded connections while being smaller in size, lighter in weight, and more economical than a fully capable power tong of similar output torque capacity and pipe size.

In addition to the embodiments described above, embodiments of the present disclosure further relate to one or more of the following paragraphs:

1. A pipe wrench for making-up or breaking-out a threaded connection between a first tubular member and a second tubular member, comprising: an upper wrench assembly configured to grip the first tubular member; a pair of upper jaw assemblies coupled to the upper wrench assembly and configured to grip the first tubular member; a lower wrench assembly configured to grip the second tubular member and coupled to the upper wrench assembly such that the upper and lower wrench assemblies are concentrically constrained, axially overlap, and radially engage with one another; a pair of lower jaw assemblies coupled to the lower wrench assembly and configured to grip the second tubular member; each of the upper and lower wrench assemblies independently comprising a frame with a curved segment containing an arc at an angle (e.g., angle $\alpha_1$, as depicted in FIG. 6) of about 160° to about 200°; and wherein the upper and lower wrench assemblies are configured to rotate the first tubular member relative to the second tubular member, and have an angle of rotation in a range from about 75° to about 180°.

2. A pipe wrench for making-up or breaking-out a threaded connection between a first tubular member and a second tubular member, comprising: an upper wrench assembly and a lower wrench assembly independently configured to grip and rotate the first tubular member relative to the second tubular member, wherein the upper and lower wrench assemblies are axially aligned and axially moveable with one another about a common axis; and a biasing mechanism disposed between the upper and lower wrench assemblies and supported by the lower wrench assembly to bias the upper and lower wrench assemblies away from one another, wherein each of the upper and lower wrench assemblies independently comprises a curved segment containing an arc at an angle of about 160° to about 200°.

3. A pipe wrench for making-up or breaking-out a threaded connection between a first tubular member and a second tubular member, comprising: an upper wrench assembly comprising: a first jaw assembly and a second jaw assembly; a first actuator operably coupled to the first jaw assembly; and a second actuator operably coupled to the second jaw assembly, wherein the first and second jaw assemblies are independently configured to grip the first tubular member via the operation of the first and second actuators; and a lower wrench assembly comprising: a third jaw assembly and a fourth jaw assembly; a third actuator operably coupled to the third jaw assembly; and a fourth actuator operably coupled to the fourth jaw assembly, wherein the third and fourth jaw assemblies are independently configured to grip the second tubular member via the operation of the third and fourth actuators, wherein the upper and lower wrench assemblies are configured to rotate the first tubular member relative to the second tubular member, and wherein each of the upper and lower wrench assemblies independently comprises a curved segment containing an arc at an angle of about 160° to about 200°.

4. A method for making-up or breaking-out threaded connections between tubular members with a pipe wrench, comprising: gripping a first tubular member with an upper wrench assembly of the pipe wrench; gripping a second tubular member with a lower wrench assembly of the pipe wrench, wherein the upper and lower wrench assemblies axially overlap and radially engage with one another; and rotating the first tubular member relative to the second tubular member, thereby making-up or breaking-out a threaded connection disposed between the first and second tubular members.

5. A method for making-up or breaking-out threaded connections between tubular members with a pipe wrench, comprising: gripping a first tubular member with an upper wrench assembly of the pipe wrench; gripping a second tubular member with a lower wrench assembly of the pipe wrench, wherein the upper and lower wrench assemblies are axially aligned and axially moveable with one another about a common axis; biasing the upper and lower wrench assemblies away from one another; and rotating the first tubular member relative to the second tubular member, thereby making-up or breaking-out a threaded connection disposed between the first and second tubular members.

6. A method for making-up or breaking-out threaded connections between tubular members with a pipe wrench, comprising: actuating a first actuator coupled to a first jaw assembly and a second actuator coupled to a second jaw assembly to grip a first tubular member between the first and second jaw assemblies disposed on an upper wrench assembly of the pipe wrench; actuating a third actuator coupled to a third jaw assembly and a fourth actuator coupled to a fourth jaw assembly to grip a second tubular member between the third and fourth jaw assemblies disposed on a lower wrench assembly of the pipe wrench; and rotating the first tubular member relative to the second tubular member, thereby making-up or breaking-out a threaded connection disposed between the first and second tubular members.

7. The pipe wrench or the method according to any one of paragraphs 1-6, wherein each of the first and second tubular members independently have an outer diameter of about 20 inches to about 48 inches.

8. The pipe wrench or the method according to any one of paragraphs 1-7, wherein the upper and lower wrench assemblies radially engage with one another through a plurality of rollers radially positioned between the upper and lower wrench assemblies to limit radial movement of the upper and lower wrench assemblies.

9. The pipe wrench or the method of paragraph 8, wherein the plurality of rollers comprise an inner set of rollers and an outer set of rollers.

10. The pipe wrench or the method of paragraph 9, wherein the biasing mechanism is radially positioned between the inner set of rollers and the outer set of rollers.

11. The pipe wrench or the method according to any one of paragraphs 1-10, further comprising a biasing mechanism disposed between the upper and lower wrench assemblies and supported by the lower wrench assembly to bias the upper and lower wrench assemblies away from one another.

12. The pipe wrench or the method of paragraph 11, wherein the upper and lower wrench assemblies axially engage with one another through a plurality of rollers disposed axially between the upper and lower wrench assemblies.

13. The pipe wrench or the method of paragraph 12, wherein a ring plate is disposed between the biasing mechanism and the plurality of rollers.

14. The pipe wrench or the method according to any one of paragraphs 1-13, wherein the upper wrench assembly is configured to rotate the first tubular member relative to the second tubular member.

15. The pipe wrench or the method according to any one of paragraphs 1-14, wherein: the pair of upper jaw assemblies comprises: a first jaw assembly and a second jaw assembly; a first actuator operably coupled to the first jaw assembly; and a second actuator operably coupled to the second jaw assembly, wherein the first and second jaw assemblies are independently configured to grip the first tubular member via the operation of the first and second actuators; and the pair of lower jaw assemblies comprises: a third jaw assembly and a fourth jaw assembly; a third actuator operably coupled to the third jaw assembly; and a fourth actuator operably coupled to the fourth jaw assembly, wherein the third and fourth jaw assemblies are independently configured to grip the second tubular member via the operation of the third and fourth actuators.

16. The pipe wrench or the method of paragraph 15, wherein: the upper and lower wrench assemblies are axially aligned and axially moveable with one another about a common axis; the first and second jaw assemblies are radially disposed on an upper frame of the upper wrench assembly about the common axis; and the third and fourth jaw assemblies are radially disposed on a lower frame of the lower wrench assembly about the common axis.

17. The pipe wrench or the method of paragraph 16, wherein: the first actuator is operably coupled to the first jaw assembly by a first linkage; the second actuator is operably coupled to the second jaw assembly by a second linkage; the third actuator is operably coupled to the third jaw assembly by a third linkage; and the fourth actuator is operably coupled to the fourth jaw assembly by a fourth linkage.

18. The pipe wrench or the method of paragraph 17, wherein: each of the first actuator and linkage and the second actuator and linkage is independently coupled to the upper frame; and each of the third actuator and linkage and the fourth actuator and linkage is independently coupled to the lower frame.

19. The pipe wrench or the method according to any one of paragraphs 1-18, wherein each jaw assembly of the pairs of upper and lower jaw assemblies comprises: a jaw body configured to radially move towards and away from the first or second tubular member; a die carrier coupled to the jaw body and configured to pivot relative to the jaw body; and one or more dies coupled to the die carrier and configured to contact the first or second tubular member.

20. The pipe wrench or the method of paragraph 19, wherein a thickness of the die carrier is configured to contact the first or second tubular member based on a diameter of the first or second tubular member.

21. The pipe wrench or the method according to any one of paragraphs 1-20, wherein: the upper and lower wrench assemblies are axially aligned and axially moveable with one another about a common axis; a plurality of upper alignment pads are radially disposed on an upper frame of the upper wrench assembly about the common axis and configured to align the first tubular member about the common axis; and a plurality of lower alignment pads are radially disposed on a lower frame of the lower wrench assembly about the common axis and configured to align the second tubular member about the common axis.

22. The pipe wrench or the method of paragraph 21, wherein thicknesses of the upper alignment pads are configured to contact the first tubular member based on a diameter of the first tubular member, and thicknesses of the lower alignment pads are configured to contact the second tubular member based on a diameter of the second tubular member.

23. The pipe wrench or the method according to any one of paragraphs 1-22, further comprising a segmented gear coupled to the upper or lower wrench assembly and configured to rotate the upper wrench assembly relative to the lower wrench assembly.

24. The pipe wrench or the method of paragraph 23, further comprising a drive gear coupled to and between the segmented gear and a drive source, wherein the drive gear is configured to receive power from the drive source to rotate the segmented gear, thereby rotating the upper wrench assembly relative to the lower wrench assembly.

25. The pipe wrench or the method of paragraph 24, further comprising a biasing mechanism to vertically support the segmented gear relative to the lower wrench assembly.

26. The pipe wrench or the method of paragraph 24, wherein the segmented gear is configured to axially move with the upper or lower wrench assembly and remain engaged with the drive gear.

27. The pipe wrench or the method of paragraph 23, further comprising a support frame coupled to the lower wrench assembly and configured to support the lower wrench assembly and the upper wrench assembly through the lower wrench assembly.

28. The pipe wrench or the method of paragraph 27, further comprising a gear casing coupled to and between the support frame and the upper wrench assembly and containing at least a portion of the segmented gear disposed therein.

29. The pipe wrench or the method of paragraph 28, further comprising a compression cylinder coupled to and between the support frame and the gear casing.

30. The pipe wrench or the method of paragraph 29, further comprising a load cell coupled to the compression cylinder and configured to measure an amount of torque applied to the threaded connection via the upper and lower wrench assemblies.

31. The pipe wrench or the method according to any one of paragraphs 1-30, wherein: each of the first actuator and the second actuator is independently coupled to the upper frame; and each of the third actuator and the fourth actuator is independently coupled to the lower frame.

32. The pipe wrench or the method according to any one of paragraphs 1-31, wherein each of the first, second, third, and fourth jaw assemblies independently comprises: a jaw body configured to radially move towards and away from the first or second tubular member; a die carrier coupled to the jaw body and configured to pivot relative to the jaw body; and one or more dies coupled to the die carrier and configured to contact the first or second tubular member.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A pipe wrench for making-up or breaking-out a threaded connection between a first tubular member and a second tubular member, comprising:

an upper wrench assembly configured to grip the first tubular member;

a pair of upper jaw assemblies coupled to the upper wrench assembly and configured to grip the first tubular member;

a lower wrench assembly configured to grip the second tubular member and coupled to the upper wrench assembly such that the upper and lower wrench assemblies are concentrically constrained, axially overlap, and radially engage with one another;

a pair of lower jaw assemblies coupled to the lower wrench assembly and configured to grip the second tubular member;

a biasing mechanism disposed between the upper and lower wrench assemblies and supported by the lower wrench assembly to bias the upper and lower wrench assemblies away from one another;

each of the upper and lower wrench assemblies independently comprising a frame with a curved segment containing an arc at an angle of about 160° to about 200°;

a segmented gear coupled to the upper or lower wrench assembly and configured to rotate the upper wrench assembly relative to the lower wrench assembly;

a drive gear coupled to and between the segmented gear and a drive source, wherein the drive gear is configured to receive power from the drive source to rotate the segmented gear, thereby rotating the upper wrench assembly relative to the lower wrench assembly;

a support frame coupled to the lower wrench assembly and configured to support the lower wrench assembly and the upper wrench assembly through the lower wrench assembly;

a gear casing coupled to and between the support frame and the upper wrench assembly and containing at least a portion of the segmented gear disposed therein; and wherein the upper and lower wrench assemblies are configured to rotate the first tubular member relative to the second tubular member, and have an angle of rotation in a range from about 75° to about 180°.

2. The pipe wrench of claim 1, wherein each of the first and second tubular members independently have an outer diameter of about 20 inches to about 48 inches.

3. The pipe wrench of claim 1, wherein the upper and lower wrench assemblies radially engage with one another through a plurality of rollers radially positioned between the upper and lower wrench assemblies to limit radial movement of the upper and lower wrench assemblies.

4. The pipe wrench of claim 3, wherein the plurality of rollers comprise an inner set of rollers and an outer set of rollers.

5. The pipe wrench of claim 4, wherein the upper and lower wrench assemblies axially engage with one another through a plurality of rollers disposed axially between the upper and lower wrench assemblies.

6. The pipe wrench of claim 5, wherein a ring plate is disposed between the biasing mechanism and the plurality of rollers.

7. The pipe wrench of claim 1, wherein the upper wrench assembly is configured to rotate the first tubular member relative to the second tubular member.

8. The pipe wrench of claim 1, wherein:

the pair of upper jaw assemblies comprises:

a first jaw assembly and a second jaw assembly;

a first actuator operably coupled to the first jaw assembly; and a second actuator operably coupled to the second jaw assembly, wherein the first and second jaw assemblies are independently configured to grip the first tubular member via the operation of the first and second actuators; and the pair of lower jaw assemblies comprises:

a third jaw assembly and a fourth jaw assembly;

a third actuator operably coupled to the third jaw assembly; and a fourth actuator operably coupled to the fourth jaw assembly, wherein the third and fourth jaw assemblies are independently configured to grip the second tubular member via the operation of the third and fourth actuators.

9. The pipe wrench of claim 8, wherein:

the upper and lower wrench assemblies are axially aligned and axially moveable with one another about a common axis;

the first and second jaw assemblies are radially disposed on an upper frame of the upper wrench assembly about the common axis; and the third and fourth jaw assemblies are radially disposed on a lower frame of the lower wrench assembly about the common axis.

10. The pipe wrench of claim 9, wherein:

the first actuator is operably coupled to the first jaw assembly by a first linkage;

the second actuator is operably coupled to the second jaw assembly by a second linkage;

the third actuator is operably coupled to the third jaw assembly by a third linkage; and the fourth actuator is operably coupled to the fourth jaw assembly by a fourth linkage.

11. The pipe wrench of claim 10, wherein:

each of the first actuator and linkage and the second actuator and linkage is independently coupled to the upper frame; and each of the third actuator and linkage and the fourth actuator and linkage is independently coupled to the lower frame.

12. The pipe wrench of claim 1, wherein each jaw assembly of the pairs of upper and lower jaw assemblies comprises:

a jaw body configured to radially move towards and away from the first or second tubular member;

a die carrier coupled to the jaw body and configured to pivot relative to the jaw body; and one or more dies coupled to the die carrier and configured to contact the first or second tubular member.

13. The pipe wrench of claim 12, wherein a thickness of the die carrier is configured to contact the first or second tubular member based on a diameter of the first or second tubular member.

14. The pipe wrench of claim 1, wherein:

the upper and lower wrench assemblies are axially aligned and axially moveable with one another about a common axis;

a plurality of upper alignment pads are radially disposed on an upper frame of the upper wrench assembly about the common axis and configured to align the first tubular member about the common axis; and a plurality of lower alignment pads are radially disposed on a lower frame of the lower wrench assembly about the common axis and configured to align the second tubular member about the common axis.

15. The pipe wrench of claim 14, wherein thicknesses of the upper alignment pads are configured to contact the first tubular member based on a diameter of the first tubular member, and thicknesses of the lower alignment pads are configured to contact the second tubular member based on a diameter of the second tubular member.

16. The pipe wrench of claim 1, wherein the segmented gear is configured to axially move with the upper or lower wrench assembly and remain engaged with the drive gear.

17. The pipe wrench of claim 1, further comprising:

a compression cylinder coupled to and between the support frame and the gear casing; and a load cell coupled to the compression cylinder and configured to measure an amount of torque applied to the threaded connection via the upper and lower wrench assemblies.

18. A method for making-up or breaking-out threaded connections between tubular members with a pipe wrench, comprising:

gripping a first tubular member with an upper wrench assembly of the pipe wrench;

gripping a second tubular member with a lower wrench assembly of the pipe wrench, wherein the upper and lower wrench assemblies axially overlap and radially engage with one another and a support frame coupled to the lower wrench assembly that supports the lower wrench assembly and the upper wrench assembly through the lower wrench assembly;

biasing the upper and lower wrench assemblies away from one another; and rotating the first tubular member relative to the second tubular member via a segmented gear coupled to the upper or lower wrench assembly, the segmented gear rotated via a drive gear that is coupled to and between the segmented gear and a drive source and that receives power from the drive source, thereby making-up or breaking-out a threaded connection disposed between the first and second tubular members, wherein at least a portion of the segmented gear is disposed within a gear casing coupled to and between the support frame and the upper wrench assembly.

19. The method of claim 18, wherein each of the first and second tubular members independently have an outer diameter of about 20 inches to about 48 inches.

* * * * *